US012760510B1

(12) United States Patent
Fiebel et al.

(10) Patent No.: US 12,760,510 B1
(45) Date of Patent: Oct. 13, 2026

(54) PANEL HOME AND METHODS THEREFOR—V

(71) Applicant: Revolution Homes, LLC, Penn Valley, PA (US)

(72) Inventors: William Fiebel, Succasunna, NJ (US); Ari Naim, Tenafly, NJ (US); John Moldauer, Far Hills, NJ (US)

(73) Assignee: Revolution Homes, LLC, Penn Valley, PA (US)

( * ) Notice: Subject to any disclaimer, the term of this patent is extended or adjusted under 35 U.S.C. 154(b) by 181 days.

(21) Appl. No.: 18/594,810

(22) Filed: Mar. 4, 2024

Related U.S. Application Data

(60) Provisional application No. 63/449,420, filed on Mar. 2, 2023, provisional application No. 63/449,408, filed on Mar. 2, 2023, provisional application No. 63/449,434, filed on Mar. 2, 2023, provisional application No. 63/449,448, filed on Mar. 2, 2023, provisional application No. 63/449,456, filed on Mar. 2, 2023, provisional application No. 63/449,454, filed on Mar. 2, 2023, provisional application No. 63/449,440, filed on Mar. 2, 2023, provisional application No. 63/449,444, filed on Mar. 2, 2023.

(51) Int. Cl.
*E04B 1/343* (2006.01)
*E04B 1/348* (2006.01)

(52) U.S. Cl.
CPC ..... *E04B 1/34321* (2013.01); *E04B 1/34869* (2013.01)

(58) Field of Classification Search
CPC ..... E04B 1/34807; E04B 1/34869; E04B 1/34321
USPC ..... 52/79.1
See application file for complete search history.

(56) References Cited

U.S. PATENT DOCUMENTS

| | | | |
|---|---|---|---|
| 2,194,279 | A | 3/1940 | Goldsborough |
| 3,474,580 | A | 10/1969 | Smeeth |
| 3,510,997 | A | 5/1970 | Ratych |
| 3,552,075 | A | 1/1971 | Crump |
| 3,553,923 | A | 1/1971 | Dompas |
| 3,641,724 | A | 2/1972 | Palmer |
| 3,680,273 | A | 8/1972 | Bigelow, Jr. |
| 3,762,112 | A | 10/1973 | Evans et al. |
| 3,906,686 | A | 9/1975 | Dillon |

(Continued)

OTHER PUBLICATIONS

Landmark Home and Land Company, webpage: https://www.lhlc.com/panel.htm , copyright 2024.

(Continued)

*Primary Examiner* — Paola Agudelo
(74) *Attorney, Agent, or Firm* — Kaplan Breyer Schwarz, LLP

(57) ABSTRACT

A panel house comprises a plurality of factory-built panels. The panels are essentially "finished" elements, incorporating requisite interior and exterior surfaces and appropriate internals (e.g., thermal insulation, electrical, etc.). The panels are physically adapted to couple to one another, at a home site, via a few straightforward operations, keeping post-assembly site work to a minimum. Coupling of the panels proceeds in a predetermined assembly order per a given panel home's design, and is performed in a way that provides the requisite structural integrity and weather seal, in addition to any other considerations.

7 Claims, 27 Drawing Sheets

(56) References Cited

U.S. PATENT DOCUMENTS 3,945,157 A 3/1976 Borys
4,004,387 A 1/1977 Ellingson
4,120,133 A 10/1978 Rodgers et al.
4,447,996 A * 5/1984 Maurer, Jr. ..... E04B 1/34869 52/745.02
4,450,617 A 5/1984 Dillon
4,501,098 A 2/1985 Gregory
4,671,032 A 6/1987 Reynolds
4,788,802 A 12/1988 Wokas
4,856,244 A 8/1989 Clapp
5,724,773 A * 3/1998 Hall ..... E04H 3/02 52/220.8
5,735,639 A 4/1998 Payne et al.
5,813,174 A 9/1998 Waller
6,014,842 A * 1/2000 Matsubara ..... E04C 2/384 52/234
7,168,216 B2 1/2007 Hagen, Jr.
8,407,946 B1 4/2013 Aaron
8,621,787 B2 1/2014 Barry et al.
8,621,818 B1 1/2014 Glenn et al.
8,650,806 B1 * 2/2014 Condie ..... E04H 1/1277 52/79.5
9,222,261 B2 12/2015 Weeks
9,297,167 B1 3/2016 Stockton
9,441,357 B1 9/2016 Vafaee
9,702,152 B2 7/2017 Sievers et al.
10,179,630 B2 1/2019 Wee
10,364,572 B2 * 7/2019 Collins ..... E04C 2/34
10,538,905 B2 * 1/2020 Pirrung ..... E04B 5/02
10,590,671 B1 3/2020 Jee et al.
11,118,347 B2 9/2021 Sievers et al.
11,377,843 B2 7/2022 Ramos et al.
11,619,041 B2 * 4/2023 Mullaney ..... E04B 1/34326 52/79.1
11,629,491 B1 4/2023 Meagher et al.
12,392,128 B2 8/2025 Balinbin
12,590,454 B2 3/2026 Ness
2005/0066589 A1 3/2005 Bedell et al.
2006/0059792 A1 * 3/2006 Tiramani ..... E04B 1/3442 52/79.1
2006/0185266 A1 * 8/2006 O'Callaghan ..... E04B 1/34869 52/741.1
2007/0256391 A1 11/2007 Mifsud et al.
2007/0266649 A1 11/2007 Overmyer et al.
2008/0236056 A1 10/2008 Hourihan
2010/0126082 A1 * 5/2010 McLuskey ..... E04B 1/34869 52/220.1
2011/0296778 A1 * 12/2011 Collins ..... E04C 2/521 52/745.1
2012/0047843 A1 3/2012 Mcknight
2012/0317898 A1 * 12/2012 Strachan ..... E04B 1/34347 52/79.5
2013/0152485 A1 * 6/2013 Austin ..... E04B 1/35 52/79.8
2014/0102019 A1 * 4/2014 Love ..... E04F 17/08 52/220.1
2014/0352232 A1 12/2014 Malakauskas et al.
2015/0152634 A1 6/2015 Unger
2016/0002938 A1 * 1/2016 Vale ..... E04B 1/34869 52/27
2016/0122997 A1 5/2016 Smith
2016/0208489 A1 7/2016 Gibson
2016/0326737 A1 * 11/2016 Krokfors ..... E04B 1/34869
2017/0335561 A1 * 11/2017 Wickramasekera .... H02S 20/23
2019/0234063 A1 8/2019 Garcia-Abril Ruiz
2019/0277016 A1 9/2019 Ahern
2019/0277020 A1 9/2019 Ahern
2020/0332513 A1 10/2020 Rubler
2020/0340232 A1 10/2020 Yu et al.
2021/0079645 A1 3/2021 Wheeler et al.
2021/0207375 A1 7/2021 Leahy
2021/0246652 A1 8/2021 May
2021/0363747 A1 * 11/2021 Leclerc ..... A47B 77/08
2021/0404183 A1 12/2021 May
2024/0011277 A1 1/2024 Ct et al.
2024/0076872 A1 3/2024 May
2026/0035907 A1 2/2026 Jones et al.

OTHER PUBLICATIONS

Amwood Building Systems, webpage: https://www.amwoodhomes.com/about-our-homes/what-is-a-panelized-home/: see you tube video: https://youtu.be/m1oUOa9MvTQ , copyright 2024.
Non-Final Rejection Mailed on Oct. 23, 2025 for U.S. Appl. No. 18/594,403, 25 page(s).
Non-Final Rejection Mailed on Dec. 23, 2025 for U.S. Appl. No. 18/594,701, 11 page(s).
Non-Final Rejection Mailed on Jan. 6, 2026 for U.S. Appl. No. 18/594,520, 8 page(s).
Final Rejection Mailed on Apr. 20, 2026 for U.S. Appl. No. 18/594,403, 32 page(s).
Non-Final Rejection Mailed on Feb. 9, 2026 for U.S. Appl. No. 18/594,345, 15 page(s).

* cited by examiner

PANEL HOME AND METHODS THEREFOR—V

STATEMENT OF RELATED CASES

This specification claims priority of U.S. Patent Applications 63/449,408, 63/449,420, 63/449,434, 63/449,440, 63/449,444, 63/449,448, 63/449,454, and 63/449,456, all of which were filed on Mar. 2, 2023, and all of which are incorporated by reference herein.

FIELD OF THE INVENTION

The present invention relates to home construction.

BACKGROUND

There are currently a few construction options for residential homes: stick-built homes, manufactured homes, modular homes, and panel-built homes. Each has its advantages and disadvantages.

A stick-built home uses dimensional lumber to create roof trusses and walls, and is built from scratch, on-site, via traditional methods. Stick-built homes are highly customizable, and typically the most expensive of the available options.

A manufactured home is built in a factory, typically on a steel chassis, and then transported. The frame, structure, plumbing, electrical, insulation, and external finishings are essentially completed and inspected at the factory. Manufactured homes are quite limited in size (typically 40' long×10' wide×9' tall) and configuration, as constrained by transport considerations; namely, the size of a trailer truck that conveys the house or road regulations. These homes are subject to federal regulations, not local building codes, and can typically only be sited where zoning permits; usually trailer parks or very rural areas.

A modular home consists of a plurality of modules that are constructed in a factory. A "module" typically includes one or more rooms (e.g., bedrooms, major portions of a floor of the home, etc.). The modules are shipped to the homeowner's lot, where they are placed on a permanent foundation and pieced together to form the house. Modular homes are subject to local, state and regional building codes.

The construction of a modular home must comply with local building codes and standards in the area where the home will be placed, but they are inspected in the factory, like a manufactured home. A modular home is more customizable than a manufactured home, but less so than a stick-built home; its design is constrained by the limitations of the factory. It is very inefficient to ship a modular home, since each of the rather large modules of the modular home ships assembled, such that much of the shipping volume is "air."

In a panel-built home, much of the framing that is otherwise done onsite (i.e., "field framing") is done in a factory. In some cases, the "panels" for use in such homes are long segments of framing, such as floor panels (subfloor and underlying joists), and both interior and exterior wall panels (studs, bottom plate, top plate). In some cases, an exterior wall panel includes a frame comprising studs and a top and bottom plate, sheathing (e.g., plywood, OSB, etc.) and a house wrap, wherein the sheathing and house wrap is applied to what is intended to be the exterior-facing surface of the panel. Typically, the interior-facing surface remains completely uncovered. Interior panels are usually provided as a frame, without any covering.

Assembly of existing panel-built homes at a homesite proceeds in a manner similar to a stick-built home, but benefits, relative to a stick-built home, from factory assembly of pre-framed segments. This results in reduced build time, and more consistent framing quality, compared to a stick-built house. And compared to a manufactured home or a modular home, a panel-built home provides for considerably greater customization of design.

SUMMARY

Embodiments of the invention provide improvements in the design, fabrication, and installation of a panel house.

In accordance with the illustrative embodiment, a panel house is constructed from a plurality of factory-built panels. The panels are physically adapted to couple to one another, at the home site, via a few straightforward operations, keeping post-assembly site work to a minimum. Coupling of the panels proceeds in a predetermined assembly order per a given panel home's design, and is performed in a way that provides the requisite structural integrity and weather seal, in addition to any other considerations.

Unlike the panels used in prior-art panel-built houses, in some embodiments, panels in accordance with the present teaching are essentially "finished" elements, incorporating the requisite interior and exterior surfaces and appropriate internals (e.g., thermal insulation, electrical, etc.). In such embodiments, essentially all that is required at the home site is to erect the panels and add some simple finishes to create the various walls and roof of the home.

The panels are built in the factory using purpose-designed production tools, including, without limitation, a "stud tool" and a "panel tool," unique to applicant's manufacturing processes. The stud tool is a horizontal jig that provides repeatable and accurate placement and alignment of studs for nailing to create the structural frame of each panel. The panel tool is a movable jig that provides lift and rotation capability. During (or after) fabrication of a panel's frame, the panel tool is coupled to the frame. Once the frame is complete, it is lifted out of the stud tool via the lift capability of the panel tool. The panel tool then positions the frame at a suitable height, and optionally rotates it (to a vertical or other orientation) to facilitate adding sheetrock, siding, wiring, and the like to create a partially or fully finished panel.

The panels include roof panels, as well as other panels that create the vertical-oriented surfaces of the house. The latter type of panels includes exterior panels, for creating the exterior of the house, as well as interior panels for creating the living space within. Since the panel house is fabricated using only a few distinct types of panels, assembly lines can be utilized in the factory, the use of which optimizes build time and reduces labor costs.

There are, primarily, three types of exterior panels, including: (i) wall panels, (ii) door panels, and (iii) window panels. In the illustrative embodiment, all types of exterior panels include: (a) a structural frame, (b) an interior-facing surface finish material (e.g., painted sheetrock, Dupont Corian® interior cladding, etc.), (c) sheathing (e.g., plywood, oriented strand board [OSB], structural fiberboard, etc.), (d) an outer weather barrier, (e) an exterior-facing surface finish material, (f) thermal insulation, and (g) one or more of electrical outlets, electrical junction boxes, electrical wire (s), electrical switches (hereinafter collectively "electrical components"), etc. In some embodiments, the sheathing includes a weather barrier, such that no separate outer weather barrier is required. In some embodiments, the exterior-facing surface finish material is added at the home site.

Applicant's approach to exterior (vertical) panels differs from prior-art exterior panels in the following ways (among any others): as they leave the factory, prior art exterior panels: (i) do not include exterior-facing surface finish material, (ii) do not include panel internals (e.g., thermal insulation, electrical, etc.), and (iii) do not include interior-facing covering materials whatsoever.

In some embodiments, the exterior wall panel presents a continuous, uniform exterior-facing finish surface, whereas a door panel includes a door in a frame, and a window panel includes a window in a frame. The exterior wall panel is nominally twice the width of the door and window panels, which provides substantial design latitude. More particularly, an exterior wall panel can be replaced by either two exterior door panels, two exterior window panels, or an exterior door panel and an exterior window panel. And all exterior wall, door, and window panels are designed to couple to one another, enabling a wide array of exterior layouts.

The exterior panels are designed to be easily coupled to one another (skilled labor is not required) in a particular order on-site, and include physical adaptations for lifting, as well as those that ensure the structural integrity of the completed panel house, the creation of a weather seal, and an aesthetic final appearance.

In accordance with the present teaching, roof panels couple to one another to form the roof of the house. Prior-art panel-built houses do not use roof panels. Rather, existing panel-built houses typically create the truss structures for the roof at the factory, and install the trusses once the "panels" are installed. After the trusses are installed, sheathing and various other roofing layers are applied thereto to create the roof.

In contrast to the prior panel-built houses, roof panels in accordance with the present teachings are factory finished. In the illustrative embodiment, each includes (a) a structural frame, (b) an interior-facing surface finish material (e.g., sheetrock, wood paneling, etc.), (c) insulation, (d) internal ceiling lighting and wiring, (e) sheathing, and (f) the roofing surface (e.g., asphalt roll, etc.). In some embodiments, the roof surface is applied at the home site.

The roof panels are physically adapted to interconnect to one another so as to form a water/vapor/air barrier. The roof panels are mounted on top of and connect to the (installed) exterior panels for support. The roof panels may also be coupled to interior panels, such as via brackets, but such coupling simply provides lateral stabilization for the interior panels, as opposed to support for the roof panels.

Like the exterior, the interior layout of the house is defined via factory-built panels, although many of these panels are coupled to one another before leaving the factory to create preassembled modules. More particularly, in the illustrative embodiment, the interior of house is defined by a combination of: (i) closet modules, (ii) bathroom modules, (iii) a utilities-closet module, (iv) a kitchen backsplash assembly, (v) interior wall panels, (vi) interior door panels, and, depending on the layout of the house, (vii) ceiling panels.

This approach to the interior layout is quite different than that employed in prior-art panel-built homes. In particular, prior-art panel-built homes do not use closet modules, bathroom modules, a utilities-closet module, nor a kitchen backsplash assembly. And interior panels in accordance with the present teachings are different than those used in the prior art.

The closet module includes four panels that are coupled to one another by hinges at the factory. One of the panels includes an opening for access. The panels fold for shipping, and unfold for on-site assembly. The closet serves a dual purpose: it functions as a closet as well as providing walls that help to define the interior layout of the house. In some embodiments, the closet module only includes three panels, creating a "u-shaped" arrangement such that a fourth panel with an opening is not required. In a deployed state, the closet-module has a rectangular or square footprint.

The bathroom module, which nominally includes five panels (four walls and a floor), is assembled as a complete module in the factory, including a shower and/or tub, toilet, and sink, and all requisite electrical circuitry and electrical fixtures, conduits, and appropriate (e.g., fluidic, electrical, etc.) couplings. Additionally, the bathroom module includes a floor module. Like the closet module, the bathroom module has a dual purpose, serving as both a bathroom as well as providing walls that define the interior layout of the house. The bathroom-module has a rectangular or square footprint.

In some embodiments, all of the electrical circuitry, plumbing and vent lines are disposed in one of the four vertical panels of a bathroom module. Once on site, bathroom modules are placed in predetermined locations on the foundation (typically, but not necessarily, a concrete slab) to couple, via the fluidic couplings, to a conduit that leads below the foundation to a sewer/septic system, to a vent line, to water lines, and to a source of electrical power.

The utilities-closet module contains a hot-water heater, the main electrical panel, an air exchanger, air conduits, and vent lines for the house. The conduits from the bathroom modules couple to conduits sourced from the utilities-closet module. And like other modules, some of its walls serve as interior walls. The utilities-closet module has a rectangular or square footprint.

In some embodiments, the closets are constructed from (separate) interior wall panels at the home site. In some embodiments, the utilities closet is constructed from (separate) interior wall panels at the home site. In some embodiments, both the closets and the utilities closet are constructed at the home site from (separate) interior wall panels, such that the only module delivered to the home site is the bathroom module.

A required interior wall that is not sourced from a closet module, bathroom module, or utilities-closest module is provided by an interior panel.

Interior wall panels include a frame (wood or aluminum studs), and, in some embodiments, a finish surface material on both sides of the panel. Each interior wall panel includes electrical circuitry and any other required internals. An accessway near the bottom of the interior wall panel enables access to the internals. As previously noted, interior panels for existing panel-built houses are typically segments of bare framing (no surface finishes, electrical, etc.). Interior wall panels have a nominal width of 4 foot, but are available in custom widths as required to satisfy any interior design.

Interior doors are provided by an interior door panel, which includes a pre-hung door and a surrounding frame. In some embodiments, the interior door panel also includes electrical circuitry, for creating electrical continuity between surrounding panels, as appropriate. As with all interior panels, height is variable as a function of the design ceiling height, though is nominally 8'-0".

The electrical requirements for the kitchen are satisfied by a backsplash module, which, for flexibility and simplicity, is independent of any particular kitchen cabinetry layout or countertop layout. The backsplash module includes GFI plugs, electrical outlets for appliances, junction boxes, wiring, and the like. The location of electrical outlets can be readily adjusted to provide flexibility in kitchen cabinet layout and appliance options. Like the closet module, the backsplash module is hinged to fold for shipping.

In some embodiments, communication tags, such as RFID tags, and/or various sensors (and a transmitter, if necessary), are embedded in all panels (including at least one panel used within any of the modules) that are used to construct the panel house. The RFID tags serve as identifiers for each panel, and the tags or sensors can be used to sense a connection between adjacent panels. In some embodiments, the tags transmit identifying information about the panels, such information being in the form of an alphanumeric code, a bar code, QR code, etc.

In some embodiments, when two panels are coupled to one another, the tags or sensors sense the connection. The tags and/or sensors transmit information pertaining to the connection (e.g., the occurrence of the connection, the quality of the connection, etc.), for example, to one or more software applications running on a data processing system, which can be a smart phone, etc. The software application can thus monitor the assembly process of the home. Based on the transmitted data, the application can provide a variety of metrics. No such active monitoring is used in prior-art panel-built houses.

Whereas a prior-art panel-built house simply replaces, for the most part, "field framing" with framing in a controlled manufacturing environment, the present approach goes considerably further. For example, the manufacture and use, in some embodiments, of various fully or nearly fully finished interior and exterior panels, the use of one or more modules (bathroom, closet, utilities-closet), and various assembly methods, are all distinct from the building practices employed for existing panel-built houses.

Unlike a prior-art "panel-built" house, in some embodiments, a house in accordance with the present teachings is, effectively, a plurality of panels. And for this reason, it is referred to herein as a "panel house," as opposed to a "panel-built house." The present panel house provides a number of advantages compared to a panel-built house. Among any other benefits, finishing the panels and various creating modules at the factory results in greater consistency and improved quality, since that is no longer subject to vagaries of on-site finishing and construction (e.g., which particular crew is working, is a GC/supervisor present, weather-related issues, etc.). And also speeds on-site operations. Moreover, the nominal width (and weight) of all panels (i.e., 4' or 8') is such that they can be manipulated by a telehandler rather than a crane. In addition to reducing the level of expertise required, and the complexity and the costs of craning, the use of a telehandler facilitates on-site assembly at locations in which craning is very challenging or simply not possible due to the presence of trees, electrical wires, and the like.

DETAILED DESCRIPTION

Embodiments of the invention pertain to a panel house, including fabrication tools and methods, as well as "panels," which are the building blocks of the panel home, modules formed from panels, and methods for assembly of the panels and modules into a panel home.

In accordance with the illustrative embodiment, a panel home is constructed from a plurality of factory-built panels. The panels, which are fabricated in a factory, are substantially "finished" elements, incorporating, in some embodiments, the requisite interior and exterior surface finishes, and appropriate internals (e.g., insulation, conduits, wiring, etc). The panels are physically adapted to be coupled to one another, at the home site, to create the exterior and interior of the home via a few straightforward operations. Coupling proceeds in a predetermined assembly order per the design of a given panel house.

Figure 1A:
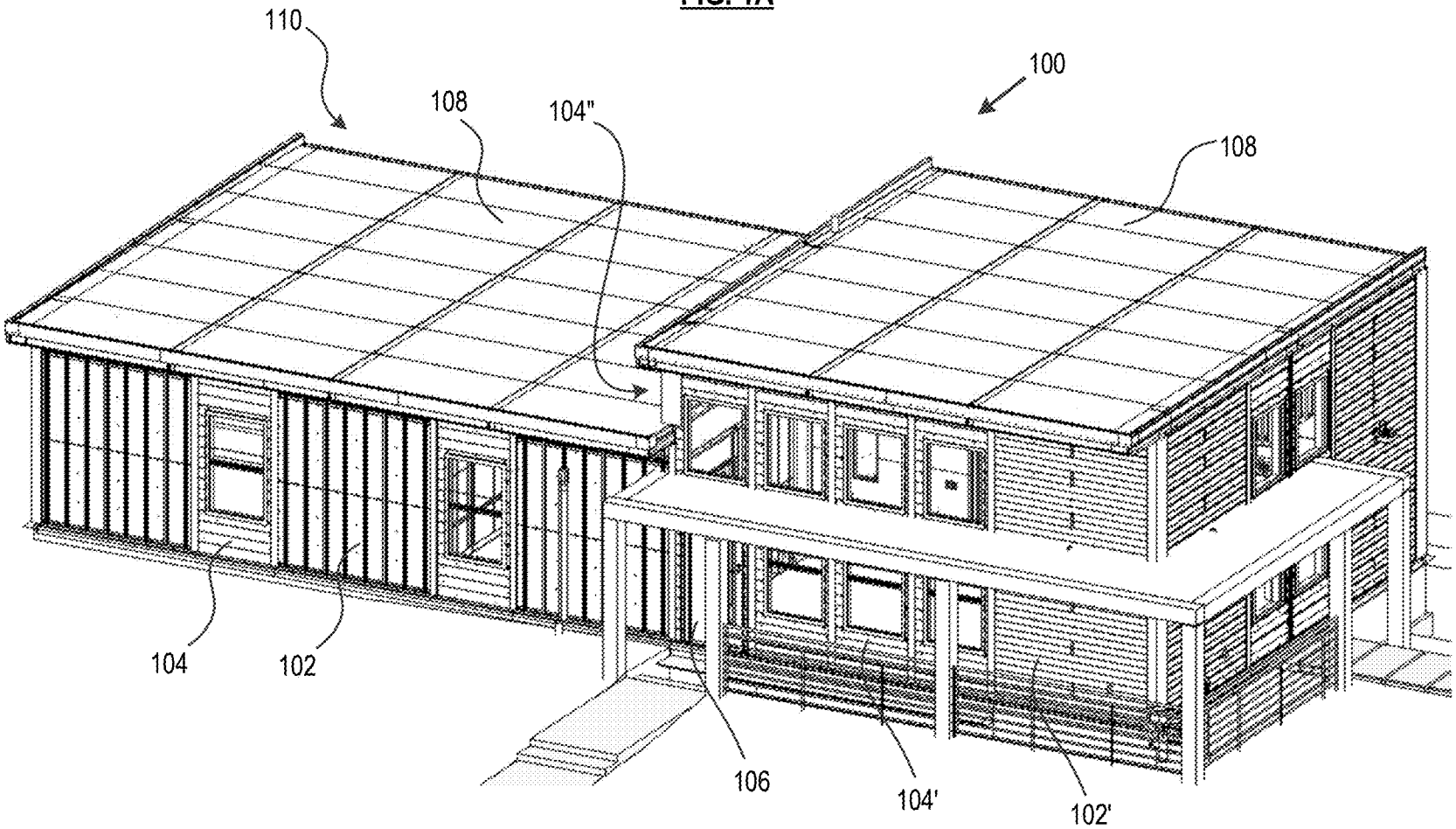
FIG. 1A depicts a panel house in accordance with the present teachings.
Figure 23:
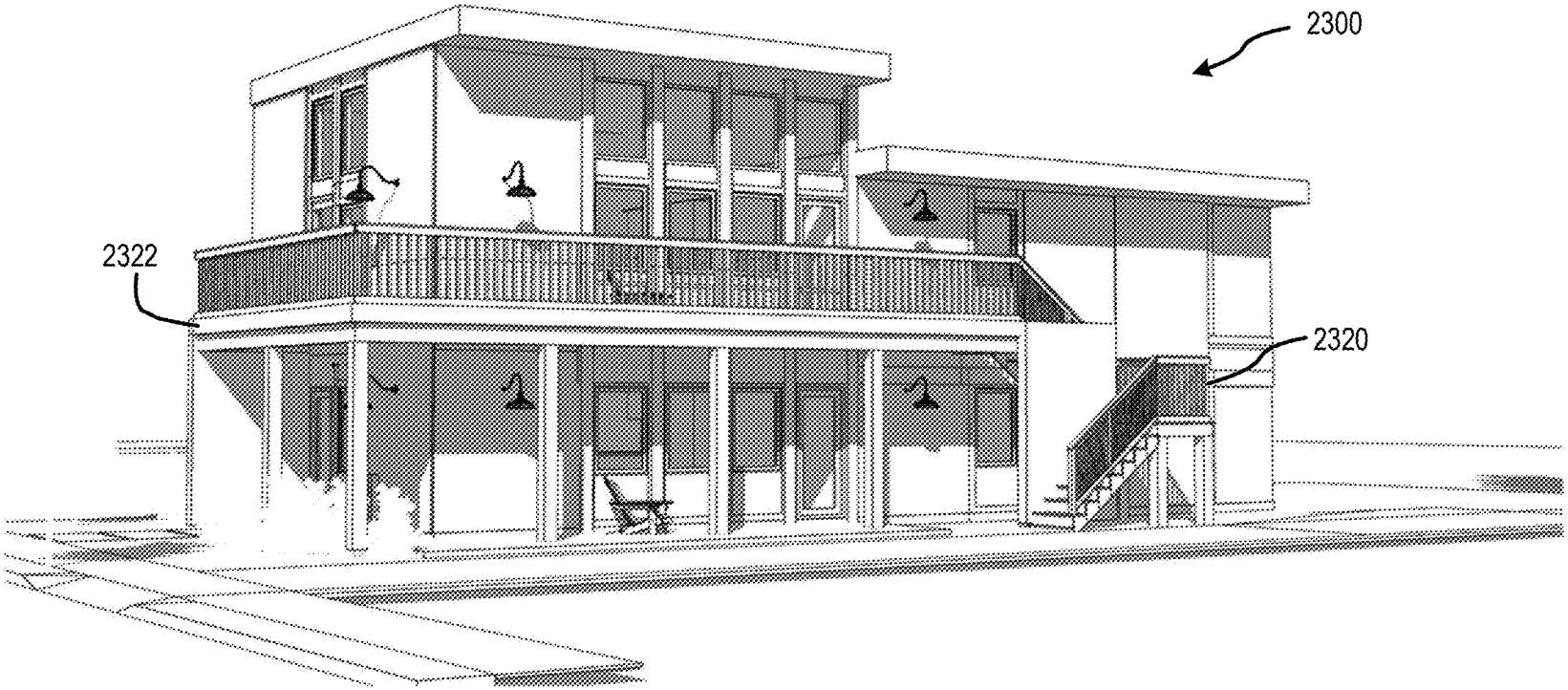
FIG. 23 depicts a panel house having two levels in accordance with the present teachings.

FIG. 1A depicts panel house 100 in accordance with the present teachings. It is to be understood that panel house 100 is illustrative of one of the many possible ways in which a panel house in accordance with the present teachings may be configured (see, e.g., FIGS. 23 and 24).

Panel house 100 comprises a plurality of different types of exterior panels, including wall panels 102, window panels 104, door panels 106, which form the vertically oriented surfaces of house 100, and roof panels 108, which collectively form roof 110. Panel house 100 also includes exterior wall panels 102' and exterior window panels 104', which are extended-height versions of wall panels 102 and window panels 104. It is notable that for panel house 100, door panel 106 is itself an extended height implementation; that is, a window is included above the door. In some other embodiments, a door panel does not include a window. Furthermore, panel house 100 includes celestory windows 104" (not visible in FIG. 1A; see FIG. 1B).

Figure 1B:
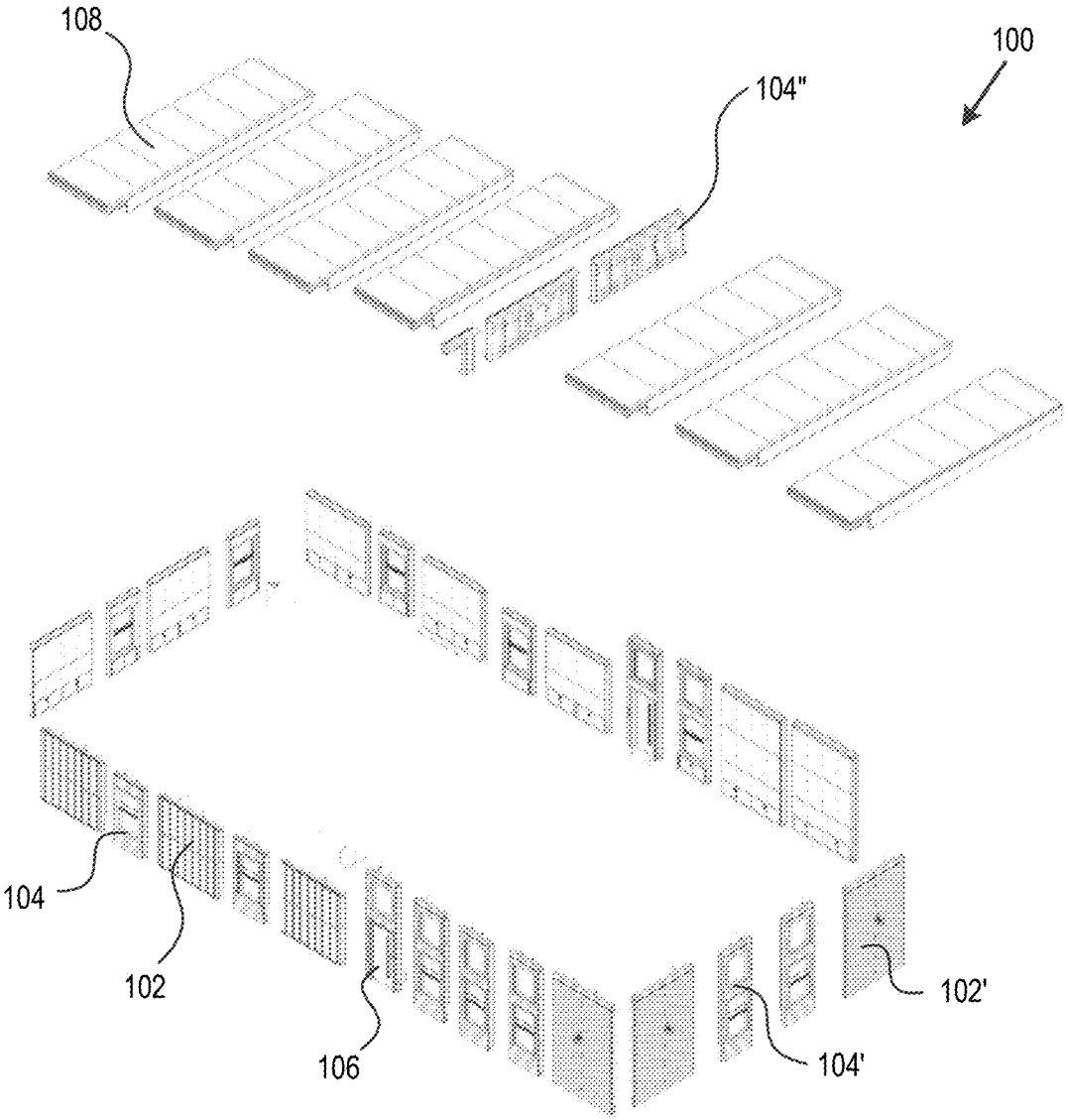
FIG. 1B depicts the panels used to fabricate the panel house of FIG. 1A.

FIG. 1B depicts an "exploded" or "deconstructed" view of panel house 100, showing the various exterior panels, as identified above, that are used to fabricate the house. Further description of the various panels is provided later in this disclosure.

Production Tools. Several tools have been developed to facilitate efficient and repeatable construction of the panels at a factory. Two of such tools are stud tool 220 and panel tool 330, which are depicted in one or more of FIGS. 2 and 3A through 3D.

Figure 2:
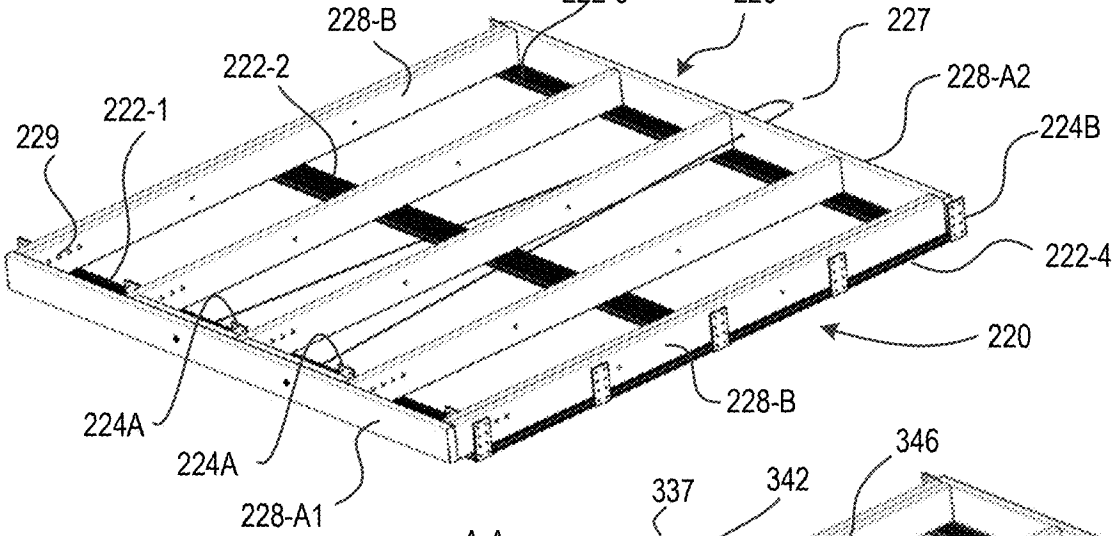
FIG. 2 depicts a stud tool and frame for a panel in accordance with the present teachings.
Figure 3A:
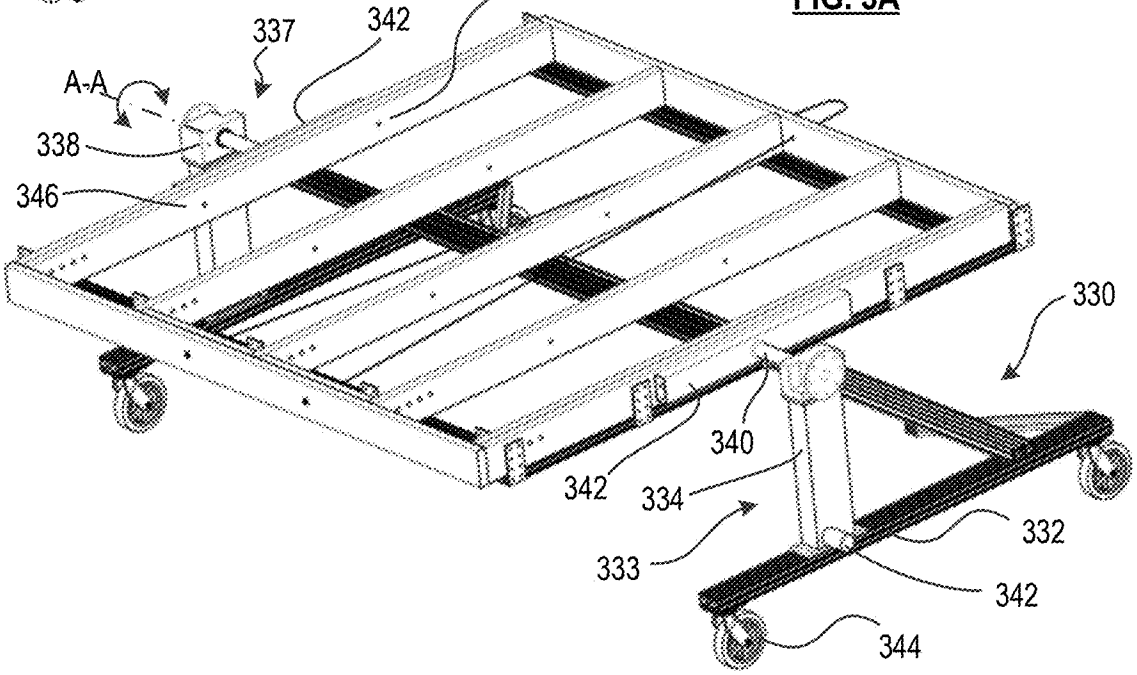
FIG. 3A depicts the stud tool and frame of FIG. 2 coupled to a panel tool in accordance with the present teachings.
Figures 3B, 3C:
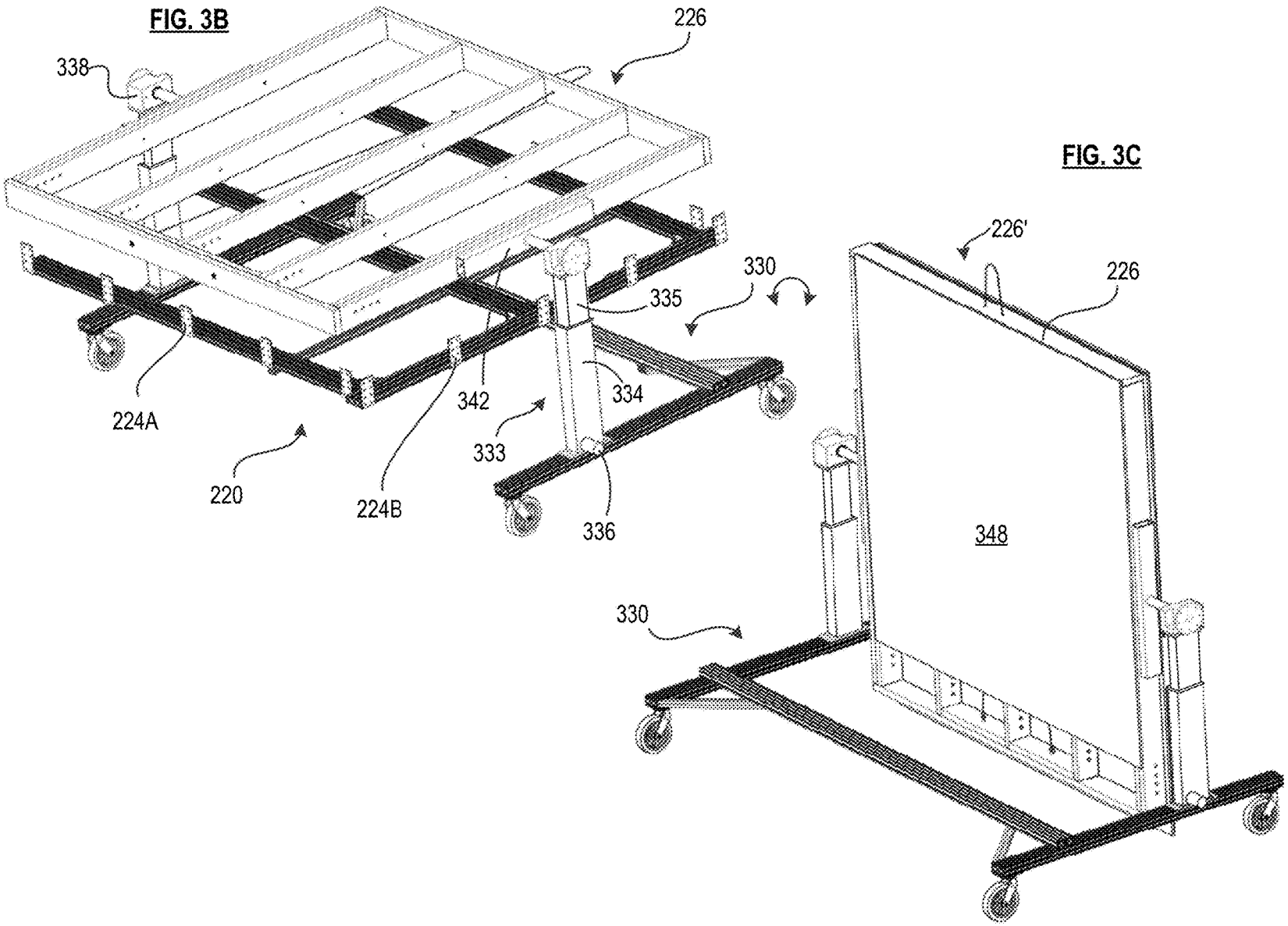
FIG. 3B depicts the panel tool of FIG. 3A being used to lift the frame out of the stud tool of FIG. 2.
FIG. 3C depicts the frame of FIG. 2 coupled to the panel tool, and rotated 90 degrees by the panel tool.

Referring now to FIG. 2 and FIG. 3B, stud tool 220 (depicted most clearly in FIG. 3B), provides for repeatable assembly of studded frame 226 for the panels of panel house 100.

Stud tool 220 comprises a plurality of (typically) metal rails 222 (i.e., rails 222-1 through 222-4), and a plurality of suitably spaced metal (typically) tabs 224A and 224B. Rails 222 have an appropriate length to create a stud tool that is appropriately sized for the panels being manufactured. Since, as described in more detail later in this specification, the panels are available in several widths and lengths, stud tools are likewise available in a variety of sizes. Although not depicted in the figures for the sake of clarity, stud tool 220 is typically disposed on a table or other support surface. The table supports stud tool 220 in a horizontal orientation, and at a height (such as about 3' to 4') that is convenient for workers that are assembling frame 226.

Referring now to FIG. 2, frame 226 comprises a plurality of studs 228. For reference herein, when used to create a panel that is intended to be vertically oriented when in use, frame 226 is defined as having a "top" and a "bottom." The "top" of frame 226 is defined by "top plate" or stud 228-A2 from which support/carry loop 227 extends. The bottom of frame 226 is defined by "bottom plate" or stud 228-A1. Those top and bottom studs are disposed at opposite ends of studs 228-B.

To facilitate manufacture of frame 226, stud tool 220 includes a plurality of tabs; namely, tabs 224A and tabs 224B. Both groups of tabs extend in a vertical direction from rails 222 (i.e., when rails are supported in a horizontal orientation on the aforementioned support table). Tabs 224A are attached to "bottom" rail 222-1 and "top" rail 222-3. Tabs 224A are spaced apart from one another on these rails, and such spacing controls the spacing between neighboring studs 228-B. Since studs are nominally separated 16" on center for 2"×4" studs, and 24" on center for 2"×6" studs, tabs 224A are spaced from one another by either 16" or 24". Tabs 224B are disposed along rail 222-4. Since tabs 224B do not function to control spacing between studs, their spacing is not critical. Tabs 224A thus have a bit more of an "alignment" function than tabs 224B.

In some embodiments, to manufacture frame 226, studs 228-A1 and 228-A2, defining the bottom and the top of frame 226, respectively, are placed against tabs 224A, which are positioned along both "bottom" rail 222-1 and "top" rail 222-3. Once the bottom and top studs are positioned, the intervening "vertically" oriented studs 228-B are positioned in stud tool 220. A first stud 228-B is abutted to tabs 224B, thus defining one end of nascent frame 226. (Typically, studs 228-B are doubled up at each end of frame 226.) Each subsequent stud 228-B is positioned against the edge of the nearest set of tabs 224A (one tab 224A attached to bottom rail 222-1 and a second tab 224A attached to top rail 222-3). After each stud 228-B is placed, it is nailed (or screwed) to bottom stud 228-A1 and top stud 228-A2. The process is repeated until frame 226 is completed. Holes 229 in studs 228-B provide for passage of electrical conduits/wiring. It will be appreciated that placement of the various studs (top, bottom and "vertically oriented") can occur in a different order than in the embodiment described above.

For embodiments in which the panel for which a frame is intended to be load bearing, the studs are typically 2"×6" dimensional lumber. For embodiments in which the panel for which a frame is intended is not load bearing, the studs may be 2"×4" dimensional lumber or aluminum.

Panel tool 330, depicted in FIGS. 3A through 3D, facilitates completion of the panels (either manually or robotically). More particularly, the panel tool facilitates: removal of frame 226 from stud tool 220, relocation of a panel to another work station, addition of any requisite panel internals (e.g., electrical circuitry, fluidic conduits, etc.), and the addition of surface materials (e.g., interior finish surface material, sheathing, weather barrier, exterior finish surface material, etc.). To this end, the panel tool is mobile, includes lift capability, and rotation capability.

To couple to frame 226, panel tool 330 is wheeled into position near the table, etc., that supports stud tool 220. At this point in the manufacturing process, frame 226 is still within stud tool 220, as depicted in FIG. 3A. Again, the table that supports stud tool 220 is not depicted.

As depicted in FIGS. 3A, panel tool 330 includes frame 332, (two) lifts 333, rotatable coupling 337, and wheels 344. Rotatable coupling 337, which enables frame 226 to be rotated as desired once attached to panel tool 330, includes receiver 338, rod 340, and attachment plate 342. Panel tool 330 couples to frame 226 via plates 342, one located at each end of the panel tool. In the illustrative embodiment, pins (not depicted) extend from the stud-facing surface of each plate 342. The pins are received by holes 346 that are formed in studs 228-B. Other arrangements for the coupling panel tool 330 to frame 226, as will occur to those skilled in the art in light of the present disclosure, may suitably be used.

Each plate 342 is attached to rod 340, which in turn is rotatably supported by receiver 338. Rod 340, and, hence, plate 342, are free to rotate about axis A-A, which aligns with the long axis of rod 340. Once plate 342 of each rotatable coupling 337 is attached to frame 226, the frame may be readily rotated via this arrangement. In the illustrative embodiment, rotation is performed manually; that is, a worker rotates frame 226 by hand. In some other embodiments, a motor is coupled to rod 340 to effect rotation.

Referring now to FIG. 3B, lift 333 includes housing 334, leg 335, and stepper motor 336. Receiver 338 of rotatable coupling 337 is disposed atop leg 335. Leg 335, which is disposed within housing 334 and free to move vertically therethrough, couples to stepper motor 336. Actuating the stepper motor causes leg 335 to move upwardly a desired distance through housing 334. As leg 335 moves upwardly, so does rotatable coupling 337, which, when frame 226 is attached to plate 342, elevates frame 226. In this manner, the lift capability of panel tool 330 is used to lift frame 226 out of stud tool 220. FIG. 3B depicts lift 333 actuated, wherein leg 335 extends some distance from housing 334, and frame 226 is lifted out of stud tool 220 (the stud tool is typically fixed/attached to a table, not depicted).

Panel tool 330 is then wheeled away from stud tool 220 and moved to another location in the factory to conduct further panel-assembly operations.

As previously described, coupled to panel tool 330, frame 226 is freely rotatable, such as to one or more orientations that facilitate further assembly operations. Such operations include, for example, the addition of sheetrock, interior and exterior surface finish materials, internals, electrical conduits, and the like, as a function of the embodiment, to create a finished panel. Panel tool 330 is capable of locking frame 226 in the desired orientation, such as via a simple mechanical arrangement (e.g., a pin that may extend into holes formed in rod 340).

FIG. 3C depicts nascent panel 226', after sheetrock 348 has been attached to both sides of frame 226. For this illustration, nascent panel 226' has been rotated ninety degrees, as facilitated by rotatable coupling 337, from a horizontal orientation as depicted in FIG. 3B to the vertical orientation shown in FIG. 3C.

Figure 3D:
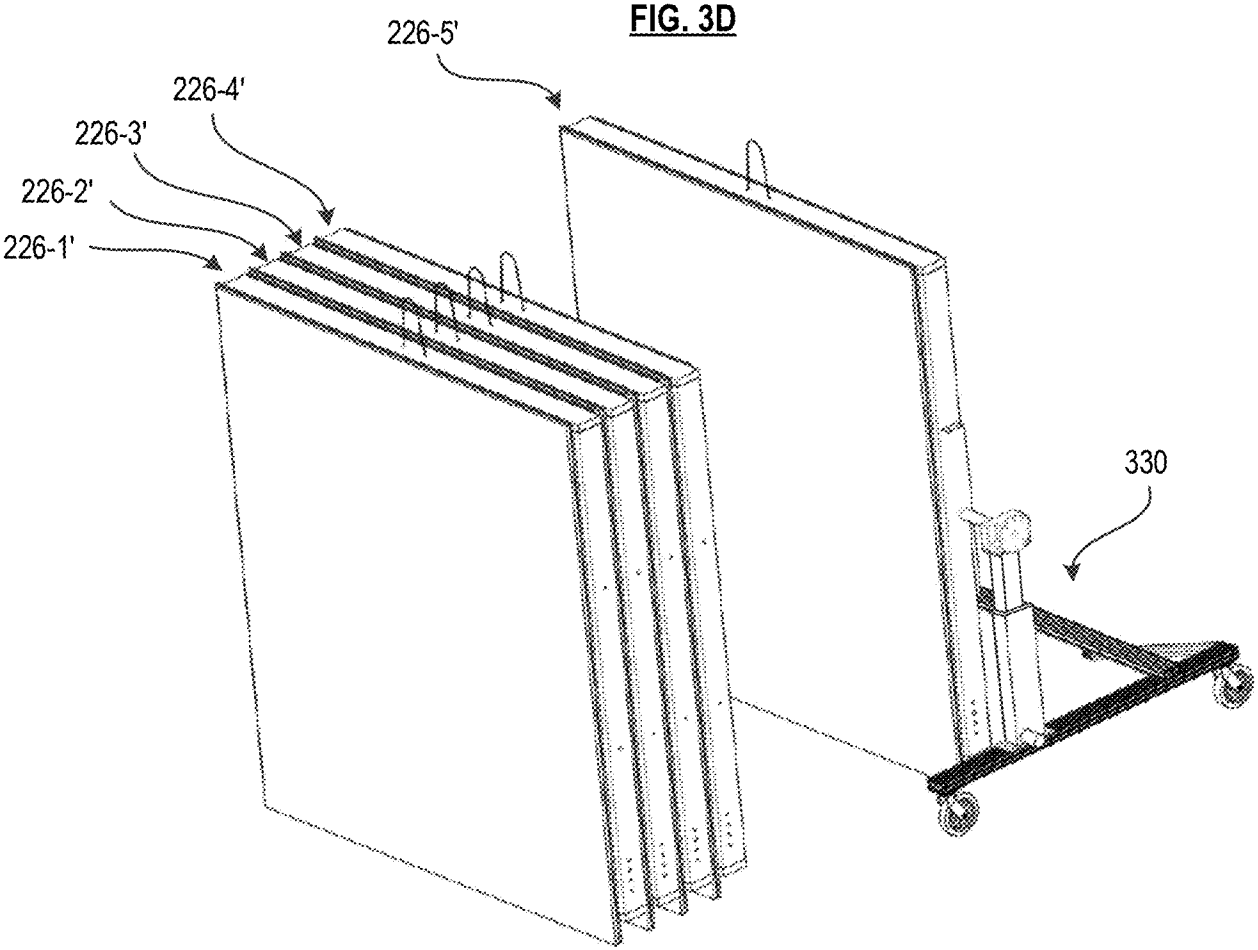
FIG. 3D depicts a plurality of partially completed panels in a vertical orientation during an idle time.

As a function, for example, of the surface finish used for the panel, there are certain operations during panel manufacture that require idle time, such as, for example, the drying of spackle that has been applied to sheetrock, the drying of paint, etc. At such stages of manufacture, a nascent panel can be oriented vertically (if not otherwise in that orientation), and then removed from panel tool 330. Other nascent panels in the same stage of manufacture on other panel tools 330 can be likewise oriented, and then removed from their respective panel tool, and all placed in close proximity to one another, as facilitated by their vertical orientation. This is depicted in FIG. 3D, wherein nascent panels 226-1', 226-2', 226-3', and 226-4' are oriented vertically and in close proximity, and wherein nascent panel 226-5' is being positioned for removal from panel tool 330 and placement near the other nascent panels. This capability increases production efficiency for a given amount of factory space. As appropriate, the nascent panels can be reattached to a panel tool for further operations.

Panels. As previously noted, a panel house in accordance with the present teachings is fabricated from a plurality of panels, such as those that create walls (i.e., vertical surfaces) of the house, the roof of the house, the ceiling of the house, and in select regions, flooring. The panels that form the vertical walls of the house include exterior panels, for forming the exterior of the house, as well as interior panels for creating the living space within. Since the panel house is fabricated using only a few distinct types of panels, assembly lines can be utilized in the factory, the use of which optimizes build time and reduces labor costs.

Exterior (vertical) panels. There are three types of exterior panels, including: (i) wall panels, (ii) door panels, and (iii) window panels. All exterior panels include: (a) a structural frame (e.g., frame 226, etc.), (b) an interior finish (e.g., painted sheetrock, Dupont Corian® interior cladding, etc.) for at least a portion of the interior-facing surface, (c) sheathing (e.g., plywood, oriented strand board [OSB], structural fiberboard, etc.) applied to the exterior-facing surface of frame, (d) an outer weather barrier applied to the sheathing (if not otherwise incorporated with the sheathing), (e) optionally, an exterior surface finish material disposed over the weather barrier, (f) thermal insulation within the structural frame, and (g) electrical components within the structural frame, as appropriate, etc. The structural frame of exterior panels nominally comprises 2'×6' dimensional lumber.

Exterior Wall Panel. An embodiment of an exterior wall panel is depicted in FIG. 4A (exterior-facing surface depicted) and in FIG. 4B (interior-facing surface depicted). (See also, FIGS. 1A and 1B.)

In the embodiment depicted in FIG. 4A, a factory-finished exterior wall panel includes exterior finish surface material 450. For wall panel 102, exterior finish surface material 450 presents a continuous surface having no openings, such as for a window or a doorway. Underneath exterior finish surface material 450 is a weather barrier (not depicted), and a layer of sheathing (not depicted). As previously noted, in some embodiments, the sheathing includes a weather barrier. Thermal insulation (not depicted) is present between the studs that compose frame 426 of wall panel 102.

Figure 4B:
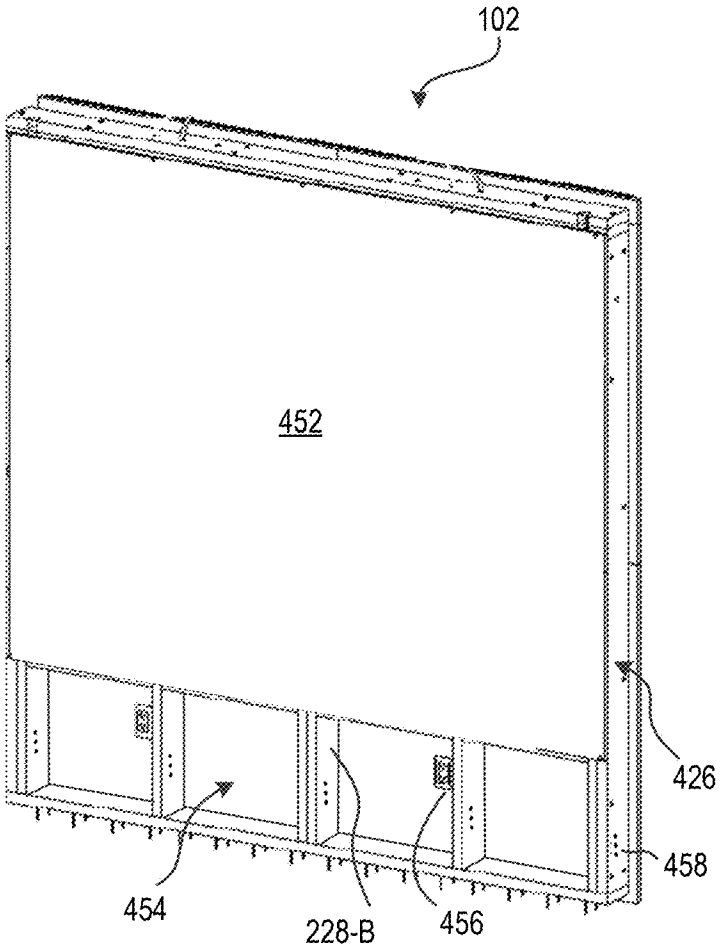
FIG. 4B depicts the interior-facing surface of the exterior wall panel of FIG. 4A.
Figure 4A:
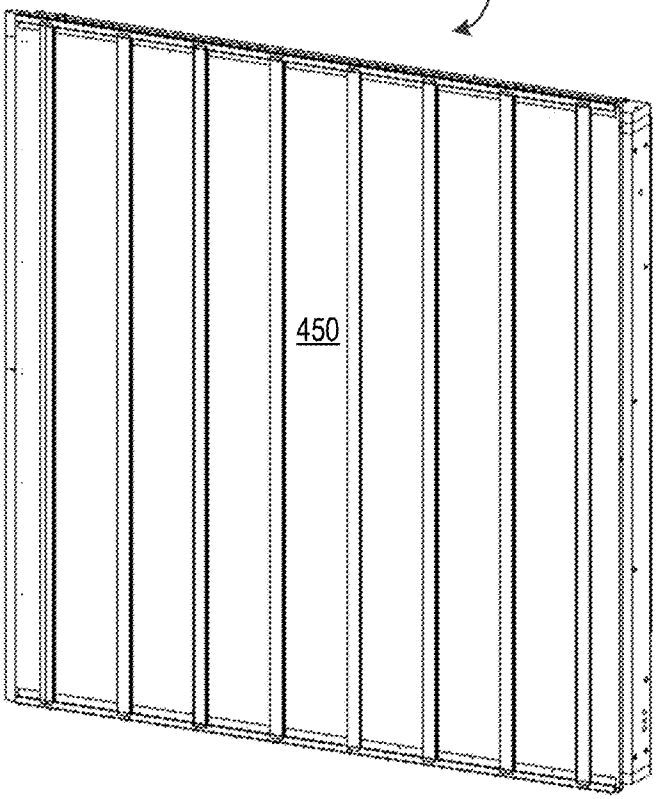
FIG. 4A depicts the exterior-facing surface of an exterior wall panel in accordance with an illustrative embodiment.

Interior finish surface material 452 is visible on interior-facing surface of exterior wall panel 102, as shown in FIG. 4B. Access to the interior of exterior wall panel 102 is provided by access way 454, which, in the illustrative embodiments, extends fully across the lower portion of panel and is accessible only at the interior facing surface. This provides access to the lower 12" to 15" of the structural frame of wall panel 102, such as to provide access to electrical conduits, junction boxes, etc. As such, interior finish surface material 452 does not extend all the way to the bottom of panel 102. In a completed panel house, accessway 454 is typically covered by a removable trim panel. In some embodiments, to provide panel-to-panel electrical connectivity, small (e.g., 1" diameter, etc.) openings 458 are provided in studs 228-B at the left and right edges of each exterior panel near the bottom thereof, as well as through all intervening studs, so that the electrical circuitry in adjacent panels can be electrically coupled. In some embodiments, a "pigtail" of electrical conduit(s) (not depicted) extends from openings 458 of panel 102 for insertion through the same openings of an adjacent panel to provide such electrically connectivity. Additionally, or alternatively, electrical conduits may extend through openings at top of panel 102, such as to provide electrical connectively to, for example, panels located on an overlying floor of the house, or ceiling or roof panels, such as for lighting, etc.

Figure 5B:
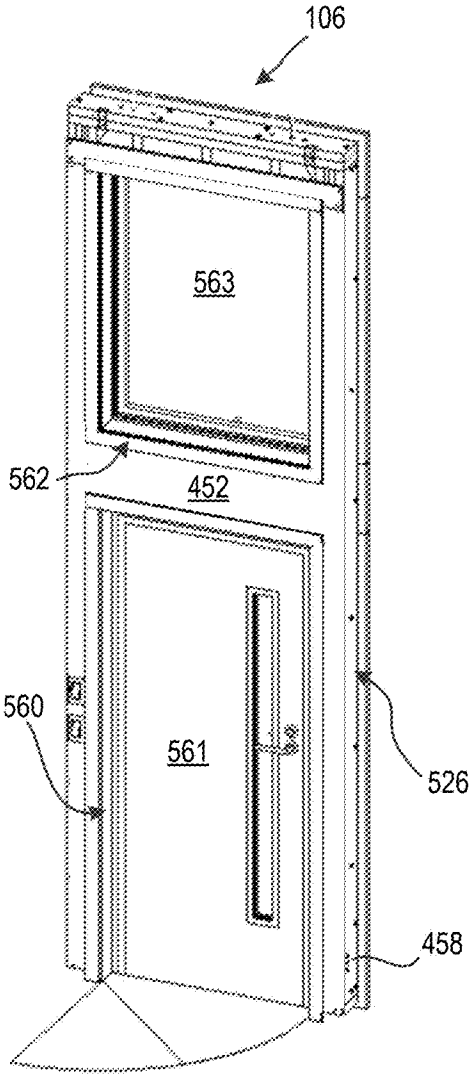
FIG. 5B depicts the interior-facing surface of the exterior door panel of FIG. 5A.
Figure 5A:
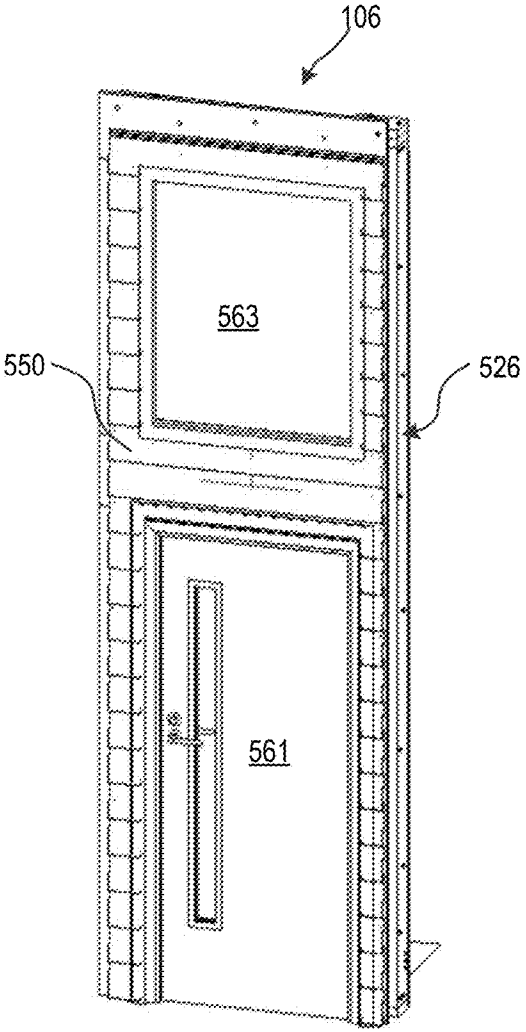
FIG. 5A depicts the exterior-facing surface of an exterior door panel in accordance with an illustrative embodiment.

Exterior Door Panel. An embodiment of an exterior door panel is depicted in FIG. 5A (exterior-facing surface depicted) and in FIG. 5B (interior-facing surface depicted). (See also, FIGS. 1A and 1B.)

In this embodiment, exterior door panel 106 includes door 561 and window 563 located above the door. Frame 526 is arranged to provide door opening 560 for receiving door 561, and window opening 562 for receiving window 563. Frame 526 has a substantially conventional framing arrangement for a doorway and window. Door 561 and window 563 are preferably, but not necessary, installed in the factory. They may alternatively be installed on-site.

In the embodiment depicted in FIG. 5A, exterior door panel 106 is fabricated at the factory to include exterior finish surface material 550 on the exterior-facing surface, which material may be the same or different than exterior finish surface material 450 of exterior wall panel 102. In some other embodiments, exterior finish surface material 550 may be applied at the home site. A weather barrier and sheathing (not depicted) are disposed between finish material 550 and exterior facing surface of frame 526. Interior finish surface material 452 is disposed on interior-facing surface of exterior door panel 106, as shown in FIG. 5B. Typically, but not necessarily, interior finish surface material 452 will be the same as that on the interior-facing surface of exterior wall panel 102.

In some embodiments, a pigtail of electrical conduit(s) extends from openings 458 of panel 106 for insertion through the same openings of an adjacent exterior wall panel 102 to provide electrically connectivity. In some other embodiments, the exterior door panel does not include a window located above the door.

Figure 6B:
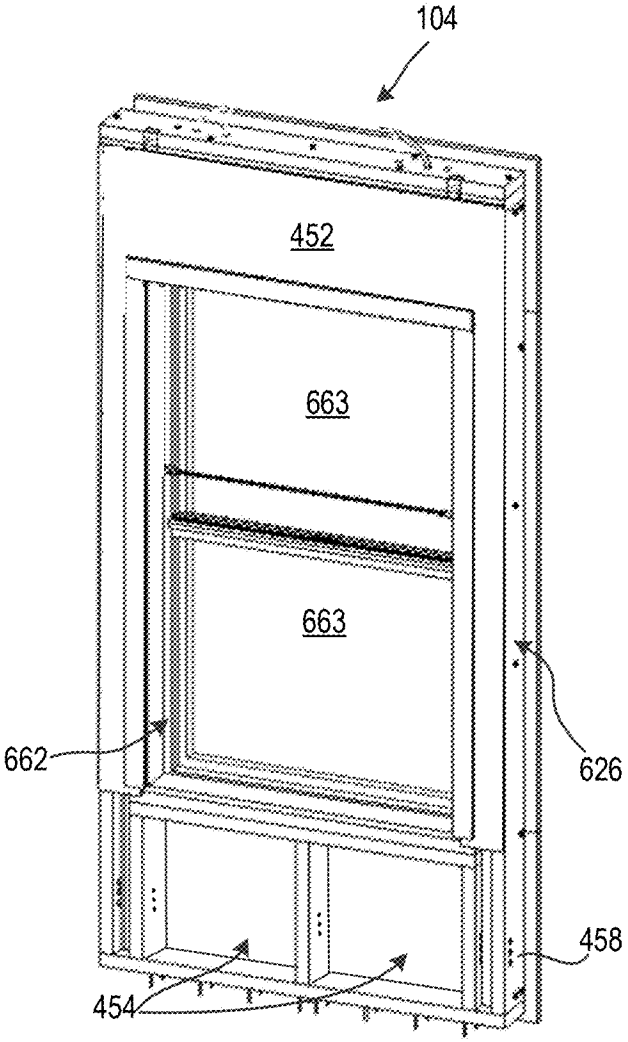
FIG. 6B depicts the interior-facing surface of the exterior window panel of FIG. 6A.
Figure 6A:
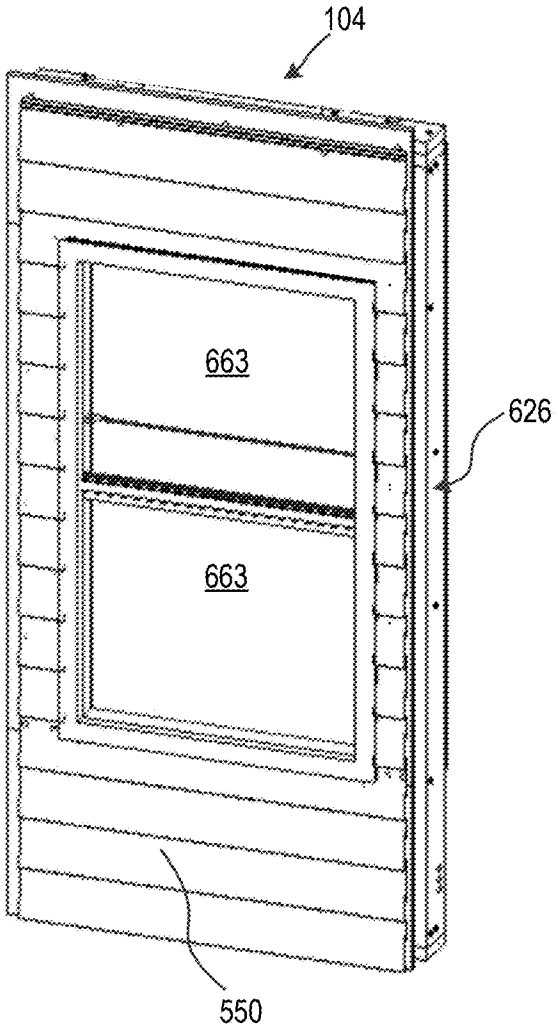
FIG. 6A depicts the exterior-facing surface of an exterior window panel in accordance with an illustrative embodiment.

Exterior Window Panel. An embodiment of an exterior door panel is depicted in FIG. 6A (exterior-facing surface depicted) and in FIG. 6B (interior-facing surface depicted). (See also, FIGS. 1A and 1B.)

Frame 626 is arranged to provide window opening 662 for receiving window 663 via a substantially conventional framing arrangement for a window. Window 663 is installed in the factory.

In the embodiment depicted in FIG. 6A, exterior window panel 104 includes exterior finish surface material 550 on the exterior-facing surface, which material will typically, but not necessarily, be the same as exterior finish surface material 550 of exterior door panel 106. In some other embodiments, exterior finish surface material 550 may be applied at the home site. A weather barrier and sheathing (not depicted) are disposed between finish material 550 and exterior facing surface of frame 626. Interior finish surface material 452 is disposed on interior-facing surface of exterior door panel 106, as shown in FIG. 6B. Typically, but not necessarily, interior finish surface material 452 will be the same as that on the interior-facing surface of exterior wall panel 102 and the interior-facing surface of exterior door panel 106.

Like exterior wall panel 102, access to the interior of exterior window panel 104 is provided by access way 454, which, in the illustrative embodiment, extends fully across the lower portion of the panel and is accessible only at the interior facing surface. This provides access to the lower 12" to 15" of the structural frame of window panel 104, such as to provide access to electrical conduits, junction boxes, etc. As such, interior finish surface material 452 does not extend all the way to the bottom of the panel. In a completed panel house, accessway 454 is typically covered by a removable trim panel (not depicted). In some embodiments, to provide panel-to-panel electrical connectivity, small (e.g., 1" diameter, etc.) openings 458 are provided in the studs at the left and right edges of each exterior panel near the bottom thereof, as well as through all intervening studs, so that the electrical circuitry in adjacent panels can be electrically coupled. In some embodiments, a pigtail of electrical conduit(s) extends from openings 458 of panel 104 for insertion through the same openings of an adjacent panel to provide such electrically connectivity.

In some embodiments, exterior wall panel 102 is twice the width of exterior window panel 104 and twice the width of exterior door panel 106, which provides substantial design latitude. That is, in terms of its width, exterior wall panel 102 can be replaced by either two exterior door panels 106, two exterior window panels 104, or exterior door panel 106 and exterior window panel 104. In the illustrative embodiment, exterior wall panel 102 has a width of 8'-0" and a height of 8'-5". Exterior window panel 104 has a width of 4'-0" and a height of 8'-5". Exterior door panel 106 has a width of 4'-0". Due to the presence of window 563 in exterior door panel 106, the door panel has a height in excess of 8'-5". In other embodiments in which an exterior door panel does not include window 563, the height of such a door panel is 8'-5".

Figure 7A:
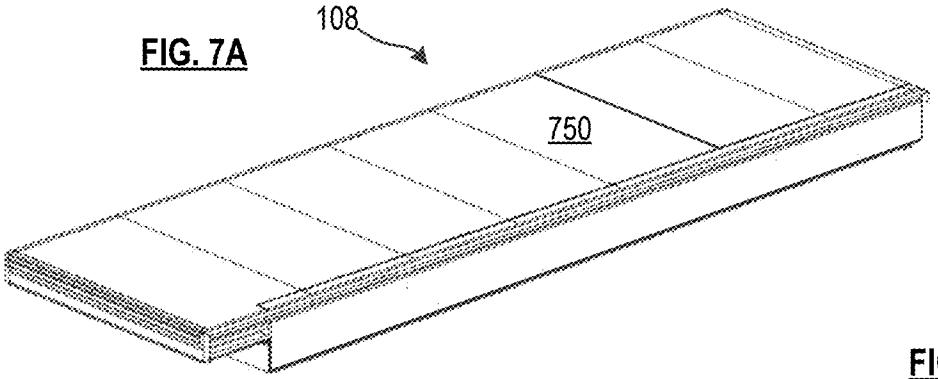
FIG. 7A depicts the exterior-facing surface of a roof panel in accordance with an illustrative embodiment.
Figure 7B:
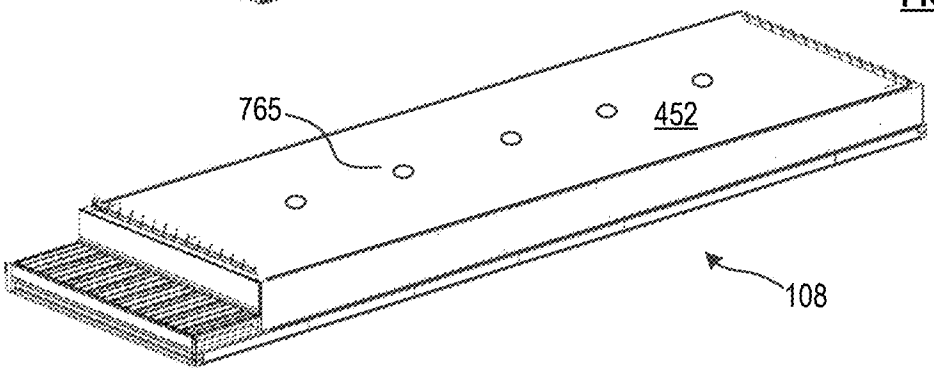
FIG. 7B depicts the interior-facing surface of the roof panel of FIG. 7A.
Figure 7C:
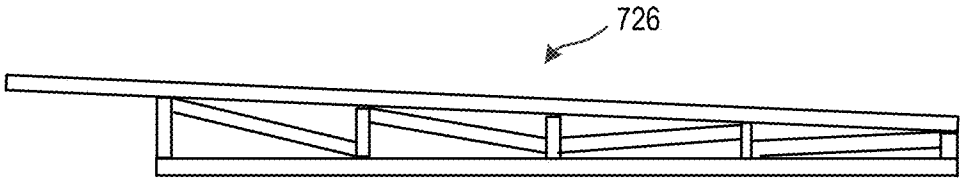
FIG. 7C depicts a frame form the roof panel of FIGS. 7A and 7B.

Roof Panels. FIG. 7A depicts the exterior-facing surface of roof panel 108 and FIG. 7B depicts the interior-facing surface of roof panel 108 for a substantially "flat" (i.e., non-gable roof) in accordance with an illustrative embodiment. (See also, FIGS. 1A and 1B.) FIG. 7C depicts a design of frame 726 for roof panel 108.

In the embodiment depicted in FIG. 7A, exterior-facing surface of roof panel 108 includes roofing material 750. A weather barrier (not depicted) and sheathing (not depicted) are disposed between roofing material 750 and the exterior facing surface of frame 726. As depicted in FIG. 7B, an interior finish surface material 452 is disposed on the interior-facing surface of frame 726. Typically, but not necessarily, interior finish surface material 452 will be the same as the finish material on the interior facing surfaces of the panels previously discussed. For example, in some embodiments, interior finish surface material 452 is painted sheet rock. In some other embodiments, interior finish surface material 452 is wood paneling.

In some embodiments, roof panel 108 includes ceiling lighting 765. In some embodiments, the lighting is wired, and, as such, roof panel 108 includes appropriate electrical circuitry. Additionally, thermal insulation is disposed within frame 726.

Roof panels 108 are coupled, side-by-side, to another to form the roof of the panel house, as described in more detail later in this specification. Roof panels 108 are physically adapted to interconnect to one another so as to form a water/vapor/air barrier. As described later in this specification, roof panels 108 are designed to be mounted on top of the exterior (and optionally interior) panels, once they are installed. As such, unlike the stick-build process of building the roof during the course of framing, roof panels 108, which are factory finished, are simply lowered into position on top of the walls and attached on-site.

Once the roof is completed, roof panels 108 must structurally support the required loads in accordance with local codes. This may be accomplished in several ways. In some embodiments, the roof panels span the width of the house. This eliminates the need for support beams and creates an open floorplan. In some of such embodiments, roof panels 108 have a nominal length of 26'-0" and width of 8'-0". They are lifted onto the completed vertical wall panels, and attached in a manner that establishes the necessary structural integrity, as discussed later in this specification. In some other embodiments, the roof panels are 8'-0"×8'-0" ft, and interconnect using an "XY" beam with support beams.

In some other embodiments, a gable roof panel (i.e., a roof architecture having two sloping sides that meet at the top in a triangular shape with a peak) is provided. As will be appreciated by those skilled in the art, the frame of a gable roof panel is supported in a different manner (i.e., different truss arrangement) than is shown in FIG. 7C. In the gable roof embodiment, each 8-foot roof section is broken into three panels. There are the two outer sloping panels that include the water barrier (i.e., shingles), and a third ceiling panel that spans from the opposing vertical exterior wall panels (that support the roof panel). There are interior support braces added on-site during installation to support the sloping panels to the horizontal ceiling panel. Thermal insulation is disposed in the frame of the ceiling panel, as well as lighting and required wires and circuitry. In conjunction with the present disclosure, it is within the capabilities of those skilled in the art to implement a gable roof panel.

Figure 8:
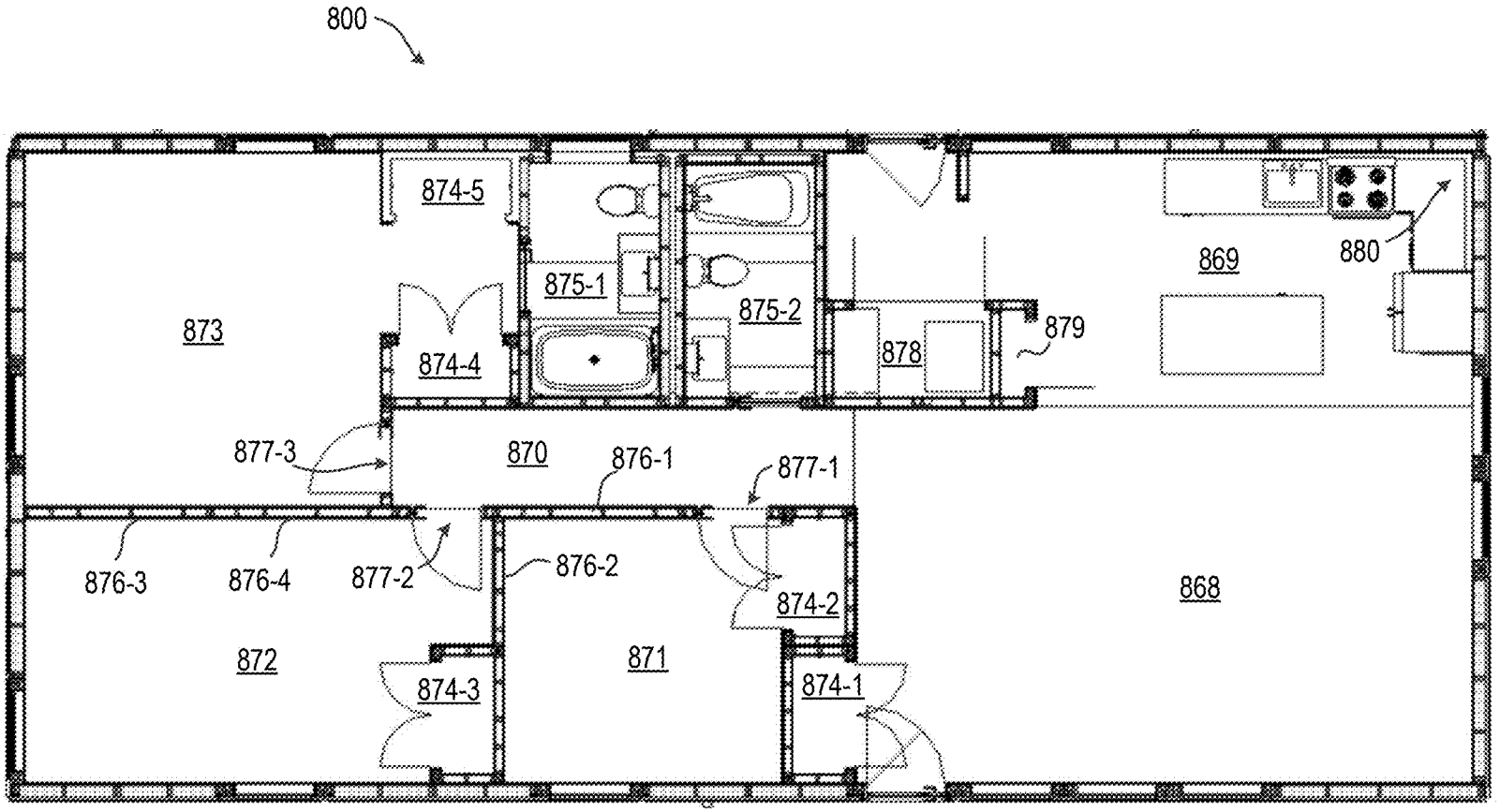
FIG. 8 depicts a floor plan of a panel house in accordance with the present teachings.

Interior Vertical Panels and Modules formed therefrom. In some embodiments, the interior layout of a panel house, such as panel house 800 depicted in FIG. 8, is defined via factory-built panels. Unlike the exterior panels, however, in some embodiments, many of these interior panels are coupled to one another at the factory to create preassembled one more types of "modules." More particularly, the interior of panel house 800 is partitioned and defined by a combination of: (i) closet modules 874, (ii) bathroom modules 875, (iii) interior wall panels 876, (iv) interior door panels 877, (v) pantry module 879, and kitchen backsplash assembly 880. Additionally, panel house 800 includes utilities closet module 878.

For panel house 800, the interior layout is defined, primarily, by five closet modules 874-1 through 874-5, two of bathroom modules 875-1 and 875-2, four interior wall panels 876-1 through 876-4, and three interior door panels 877-1 through 877-3 (which are coupled to the interior wall panels). As depicted in FIG. 8, these modules and interior wall panels, in conjunction with the exterior panels, define various spaces within panel house 800, including living room 868, hallway 870, bedrooms 871, 872, and 873, and kitchen 869. It will be appreciated that a variety of other layouts, established by organizing the various modules and panels in a different manner, are possible.

I. Interior Wall Panels 876. For panel house 800, some, but not all of the required interior walls, are provided by the presence of closet module(s) and bathroom module(s). Other interior walls, or portions thereof, are provided by an interior wall panel. Interior wall panels 876 have a nominal width of 4'-0" and a nominal height of 8'-5", but they are available in custom widths as required to satisfy any interior design layout. In this regard, closets 874, bathrooms 875, and interior door panels 877 typically have a nominal size. As such, interior size customization is, for the most part, restricted to interior wall panels 876. It will be appreciated that it is advantageous, in terms of manufacturing, to limit customization to as few types of panels as is possible.

Customization of interior wall panels 876 is primarily limited to width; the internal structure of interior wall panels 876 is typically uniform as is the height thereof (unless different-height panels are required to accommodate a change in ceiling height). That said, any remaining non-standard features for the interior of a given panel-house design are incorporated into interior wall panels 876 to maintain the standardization of the other panels and modules. For example, interior wall panels are leveraged for customization such as, for example, the location of electrical outlets, electrical switches, etc.

Interior wall panels 876 include a structural frame, sheetrock on both sides of the frame, and any required thermal insulation, as well as electrical circuitry. The interior panels are manufactured using stud tool 220 and panel tool 330, in the manner previously described. The structural frame of interior panels nominally comprises 2'×4' dimensional lumber or aluminum studs.

Moreover, as discussed in conjunction with exterior wall panels 102 and exterior window panels 104, the lower 12" to 15" of interior wall panels 876 are free of sheetrock or other permanent covering so as to provide an accessway to electrical circuitry, etc., within the panel. A trim panel covers the accessway. Both major surfaces of interior wall panel 876 are substantially the same as the interior-facing surface of exterior wall panel 102 depicted in FIG. 4B.

Regarding customization of interior wall panels 876, it is notable that the interior wall separating bedrooms 872 and 873 is depicted as being formed from two interior wall panels (i.e., panels 876-3 and 876-4). In some other embodiments, this interior wall is manufactured as a single panel having a width equal to the collective width of panels 876-3 and 876-4. The salient point here is that the "panel" approach to building a house, as disclosed herein, provides for an unprecedented degree of customization (for a non-stick built house). But that customization accrues for the panel approach itself, and does not result to any appreciable extent from the customization of individual panels. Maintaining the number of types and sizes of panels to practical minimums results in decreased manufacturing complexity, increased manufacturing efficiency, and decreased manufacturing costs. The result is a house that, compared to "manufactured" or "modular" homes (i.e., non-stick built houses), provides for considerably greater customization of design, and compared to a stick-built home, is far less costly.

(II) Closet Module 874. FIG. 9A depicts closet module 874. In the illustrative embodiment, closet module 874 includes four panels 981, 982, 983, and 985 that are coupled together at the factory, rather than at the building site. Panel 983 includes an opening for access, which is typically fitted in the factory with door(s) 984. Other panels, such as panels 981, 982, and 985 provide a continuous surface (i.e., no opening), akin to a wall panel. The panels include interior finish surface material 452. In some other embodiments, the closet module consists of three interior wall panels, the opening resulting from the omitted fourth panel functioning as the "door" for the closet module.

Each panel of the closet module comprises a frame, such as fabricated using stud tool 220 and panel tool 330 as previously described. For closet modules 874 that are not weight bearing, the frame may comprise 2'×4' dimensional lumber or aluminum studs 928. In some embodiments, the panels of closet module 874, other than the panel having an opening for a door, includes accessway 454, which provides access to any electrical circuitry within such panels. At least one panel of closet module 874 provides for panel-to-panel electrical connectivity, such that electrical conduit running through the panels the closet module can be electrically coupled to the electrical circuitry in adjacent panels that are not part of that particular closet module.

Figure 9B:
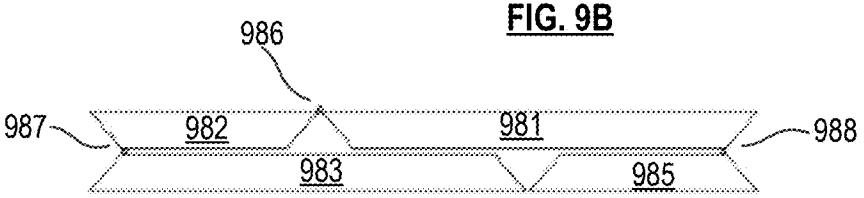
FIGS. 9B-9D depict deployment of the closet module of FIG. 9A.

Referring now to FIG. 9B, in the illustrative embodiment, closet module 874 includes three hinges 986, 987, and 988 for coupling each panel to at least one other panel. The hinges enable closet module 874 to fold, such as for transport from the factory to the home site. Hinges 987 and 988 are positioned to be "interior" hinges, and hinge 986 is positioned as an "exterior" hinge.

Figure 9C:
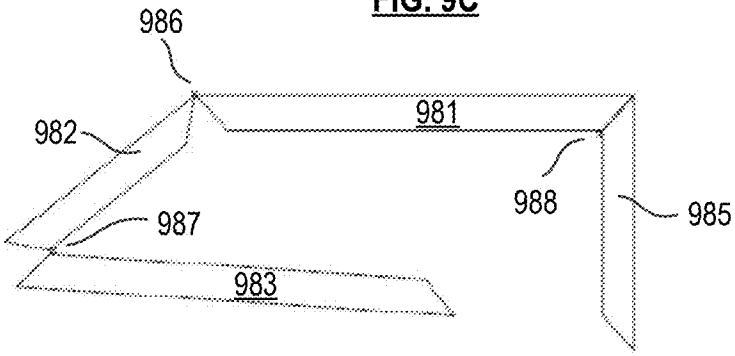
Figure 9D:
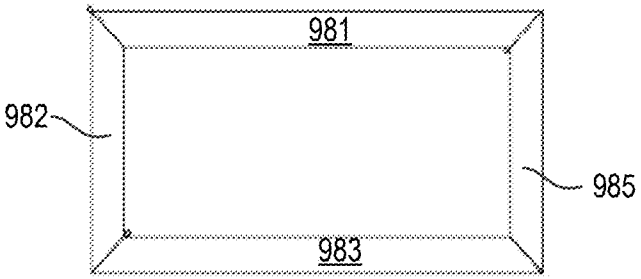
Figure 9A:
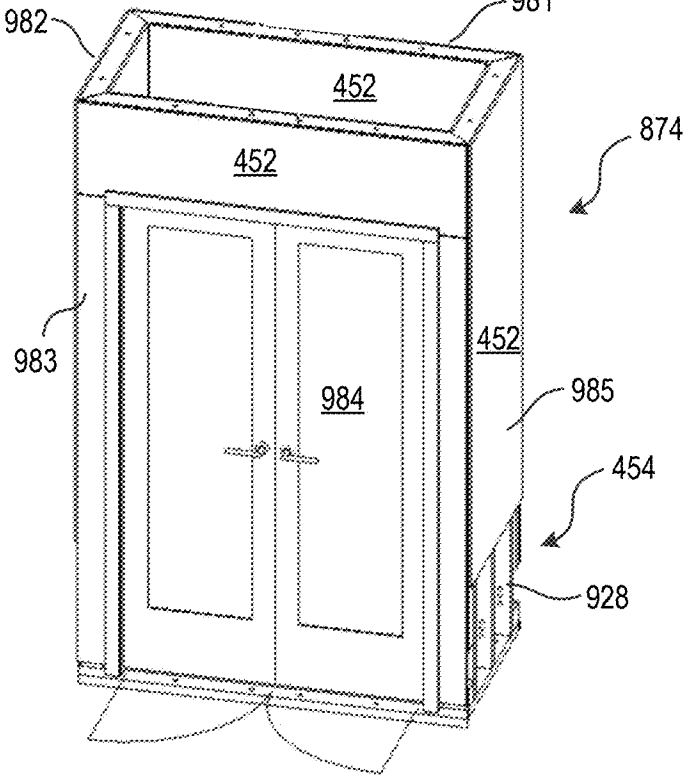
FIG. 9A depicts a closet module in accordance with an illustrative embodiment.

FIG. 9C depicts closet module 874 in a state of partial deployment. In this example, panels 981 and 985 are (partially) rotated 90 degrees with respect to one another, panel 982 has been (partially) rotated about 45 degrees with respect to panel 981, and panel 983 has been (partially) rotated about 45 degrees with respect to panel 982. FIG. 9D depicts closet module 874 in a fully deployed state, wherein adjacent panels have been rotated 90 degrees with respect to one another.

In some embodiments, closet module 874 includes closet hardware (e.g., clothing rods, shelves, etc.) that is hingeably coupled to the panels at the factory. To facilitate transport, the hardware collapses so that it is parallel to a panel, enabling closet module 874 to fold for shipping.

Once on-site, closet module 874 is lifted into place (such as by a telehandler), and panels are partially rotated as described above. In some embodiments, furniture sliders, etc., are positioned under the corners of the closet module to facilitate rotation of the panels to the final state. After the panels are rotated to the deployed state, panels 983 and 985 are coupled to one another, such as via brackets, etc.

Figure 10A:
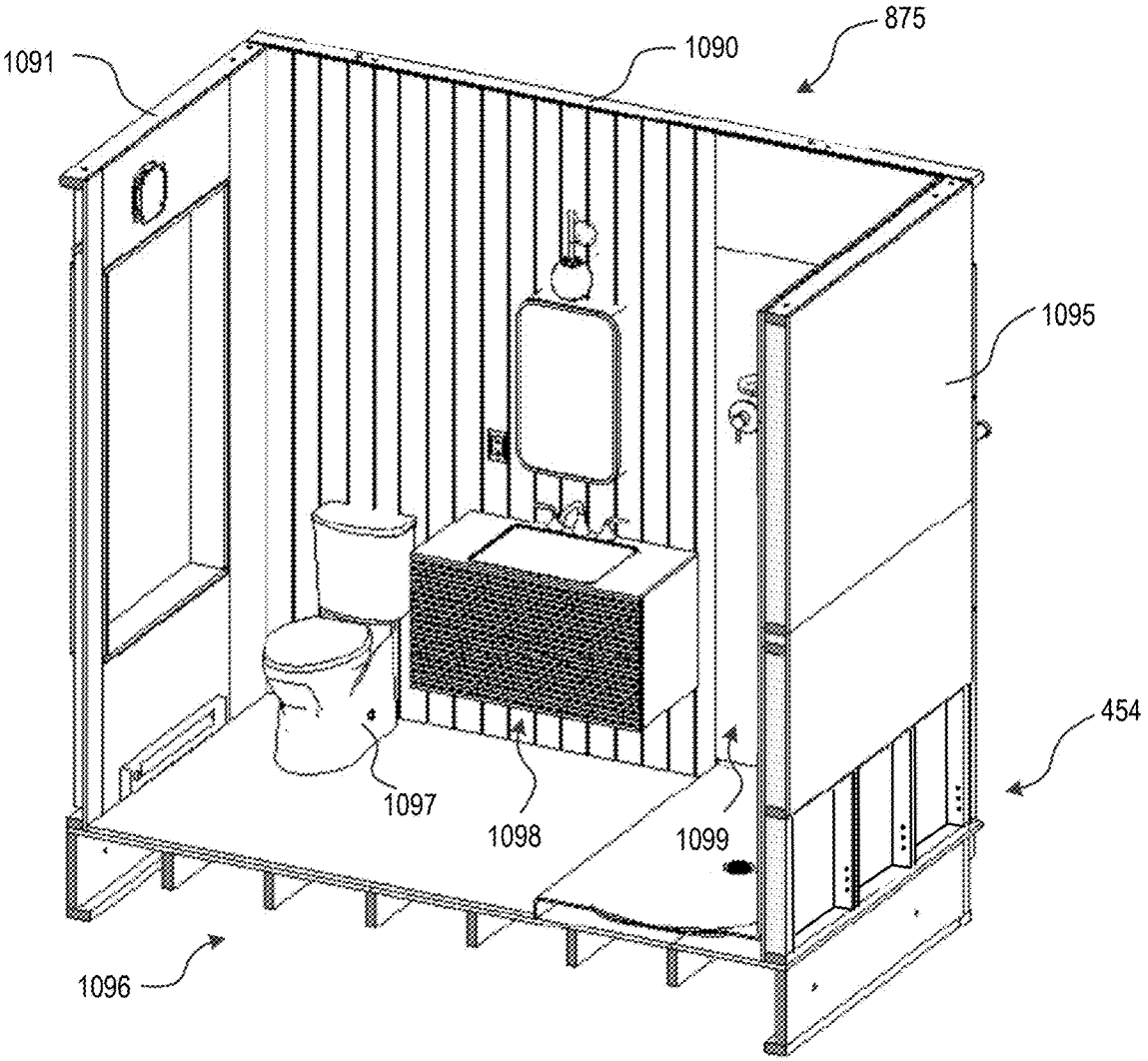
FIG. 10A depicts the interior of a bathroom module in accordance with an illustrative embodiment.
Figure 10B:
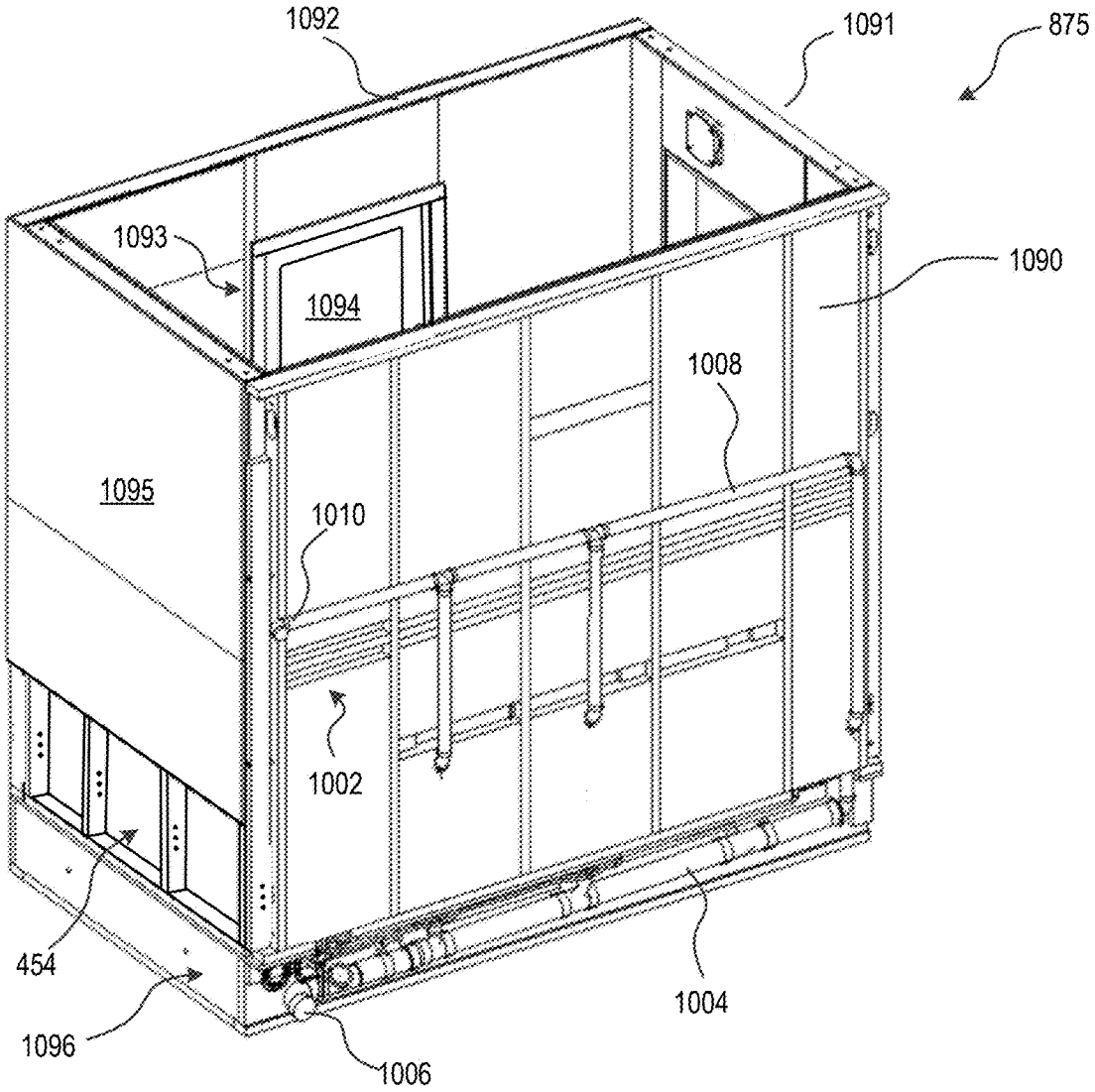
FIG. 10B depicts the exterior of the bathroom module of FIG. 10A.

(III) Bathroom Module 875. FIG. 10A depicts the interior of bathroom module 875. In the illustrative embodiment, bathroom module 875 includes four vertical panels 1090, 1091, 1092 (see FIG. 10B), and 1095 that are coupled together at the factory, rather than at the home site. As depicted in FIG. 10B, panel 1092 includes opening 1093 for access, which is typically fitted in the factory with door 1094.

Bathroom module 875 also includes toilet 1097, vanity/sink 1098, and shower 1099 (or bathtub, or combined tub/shower) with appropriate fixtures, and all requisite electrical circuitry (gfci outlet, junction boxes, electric conduits, etc.), and fluidic conduits (described further in conjunction with FIG. 10B). The interior-facing surface of the panels include, variously, light fixture(s), a mirror/medicine cabinet, a recess for shelving, and an appropriate interior finish surface material.

Additionally, an unlike other modules, bathroom module 875 includes a floor, embodied in the illustrative embodiment as floor module 1096. On-site, the bathroom module is positioned in a predetermined location with respect to the foundation, which is typically, but not necessarily, a concrete slab. The slab has an appropriate recess/cut-out to receive floor module 1096 (see FIG. 22A and accompanying description later in this specification).

As depicted in FIG. 10B, all fluidic lines and couplings are sited in, on, or below a single panel-panel 1090. In particular, hot-water and cold-water lines 1002 run through the studs in panel 1090, drain line 1004 is located in floor module 1096 directly below panel 1090, and vent lines 1008 are installed on the exterior facing surface of the studs in panel 1090. A fluidic coupling, such as coupling 1006, couples drain line 1004 to an intermediate drain line (see discussion below) running within floor module 1096 of an adjacent bathroom module 875, or the main drain line of the panel house, depending on the location of the particular bathroom module. The main drain ultimately runs through the foundation and connects to the city sewer system or a septic tank for the panel house.

Often, two of bathroom modules 875 will be adjacent to one another in the panel house. As such, at least one of those bathroom modules 875 will be remote from the location at which the drain line therefrom couples to the drain line emerging from the slab. Consequently, floor module 1096 of at least one of the bathroom modules will incorporate a drain line that runs below an appropriate one of the panels, such as panel 1095 (see, e.g., FIG. 22D). Further disclosure of the manner in which such fluidic lines couple to fluidic lines of other bathrooms and to the main fluidic lines for the home is provided later in this specification.

The salient issue with respect to bathroom module 875 is that all fluidic lines servicing a particular bathroom module 875 are sited at one panel (i.e., panel 1090) of that particular bathroom module. That increases manufacturing efficiency and streamlines the assembly process of the panel house.

Figure 21B:
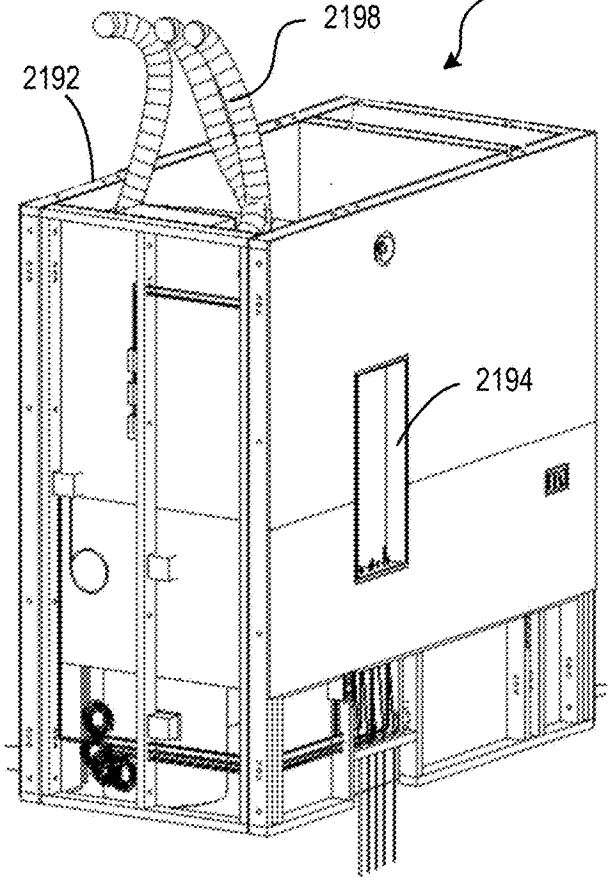
FIG. 21B depicts the exterior of the utilities-closet-module of FIG. 21A.
Figure 21A:
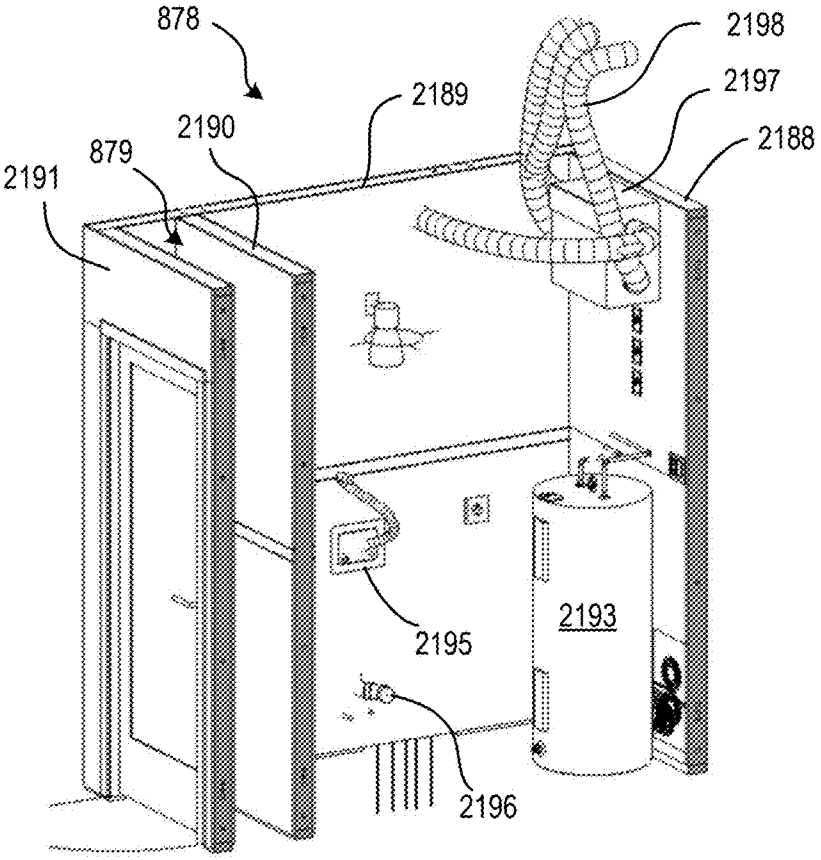
FIG. 21A depicts the interior of a utilities-closet-module in accordance with an illustrative embodiment.

(IV) Utilities-closet module 878. FIGS. 21A and 21B depict utilities-closet module 878. The utilities-closet module is the source of electric power, and filtered air within the panel house. Like other modules, utilities-closet module 878 comprises a plurality of interior wall panels 2188, 2189, and 2190, and, in the illustrative embodiment, two interior door panels 2191 and 2192. In this embodiment, utilities-closet module 878 includes pantry 879, shown here without shelves, which are typically installed at the home site. Interior door panel 2191 provides access to pantry 879 (see also, e.g., FIG. 8).

Cold water, sourced from a city supply or local well, is provided to the panel house through a water line extending through the foundation; connections to various conduits for distributing the water throughout the house (e.g., bathrooms, kitchen, etc.) are made at the home site. A portion of the water is directed to hot water heater 2193. Utilities-closet module 878 also includes electrical panel (not depicted), which is sited at location 2194, on the exterior of interior wall panel 2189. The panel receives power, such as from a local electric utility provider, and distributes it throughout the house. Utilities-closet module 878 also serves as a laundry room, and includes water supply 2195 and drain line 2196 for a washing machine (not depicted). Typically, a dryer is stacked on top of the washing machine. Utilities-closet module 878 also includes air exchanger 2197 and accompanying air conduits and air circulation lines 2198. As described further below, utilities-closet module 878 is typically placed adjacent to a bathroom.

Figure 11:
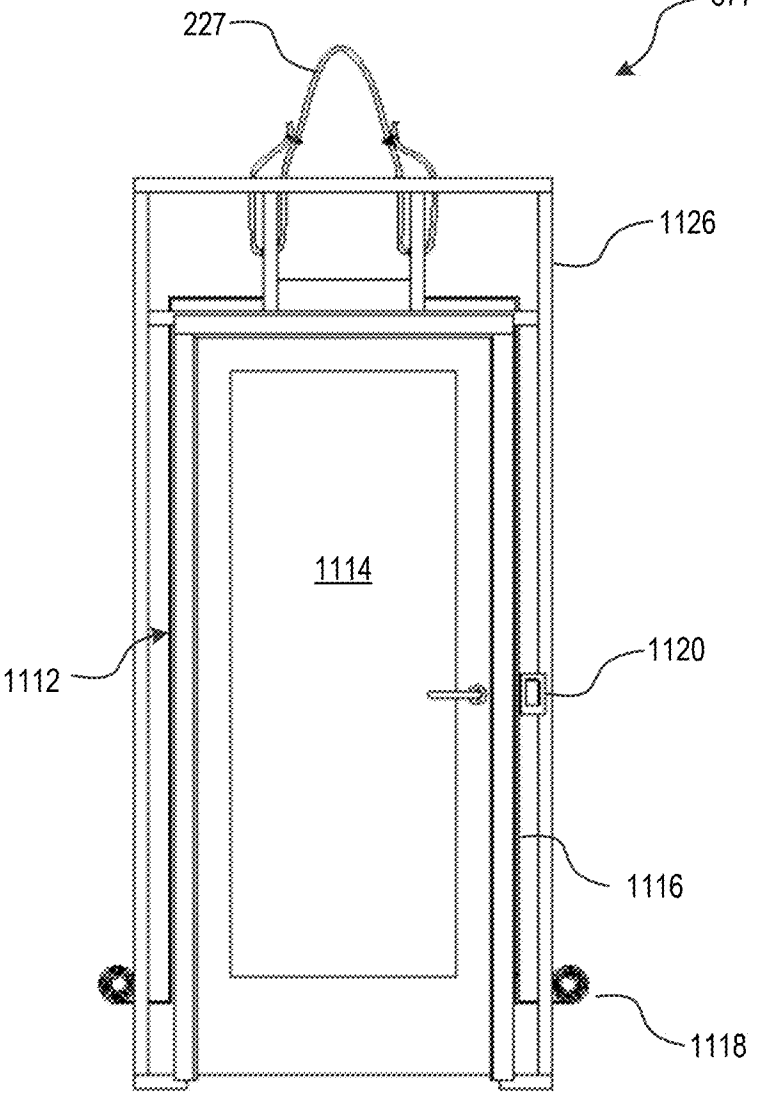
FIG. 11 depicts an interior door panel in accordance with an illustrative embodiment.

(V) Interior Door Panel 877. FIG. 11 depicts interior door panel 877. The interior door panel includes frame 1126, which provides opening 1112, which is (typically) pre-hung at the factory with door 1114. Opening 1112 is nominally sized to receive a 2'-8" door 1114 (for a bedroom). As with all panels/modules, lifting loop 227 is provided. Overall width of interior door panel 877 is nominally 3'-10". Interior door panel 877 also includes, within frame 1126, electrical conduit 1116. Conduit "pigtails" 1118 extend beyond interior door panel 877 to couple electrical conduits in adjacent panels, providing electrical continuity. As with all interior panels, the height of interior door panel 877 is a function of the design ceiling height, but is nominally 8'-0". Light switch 1120 is typically provided in interior door panel 877, and is wirelessly controlled; no wiring required.

In some embodiments, the heating, ventilation, and air conditioning ("HVAC") for a panel house as described herein is handled via a ductless heat pump system. The head unit(s) for such a system are typically located on exterior panels. This facilitates installation, and, in such a location, the condensate drains outside of the home.

VI. Ceiling/floor panel. Some embodiments of a panel house in accordance with present teachings will include more than one floor/level, such as panel house 2300 depicted in FIG. 23. To implement a multi-level design of the panel house, a ceiling/floor panel (not depicted), is provided. The ceiling/floor panel has a frame that is similar to that of "flat" roof panel 108 depicted in FIG. 7C, but without the pitch. The outside perimeter of the ceiling/floor panels will accept all exterior panels, to define the exterior wall of the overlying level of the house. The ceiling panel will also accept the sloped roof panels (for a gabled roof) for a ceiling panel of the top floor of the house. Additionally, in some embodiments, the ceiling/floor panel includes lighting and all required wiring and circuitry. For embodiments in which the foundation for the panel house is a crawl space or foundation, as opposed to a slab, the ceiling/floor panel must be used, and is installed above the sill plate is conventional fashion.

In some embodiments, balcony 2322 and exterior staircase 2320 of panel house 2300 is fabricated at the home site. In some embodiments, the balcony 2322 is assembled from factory-assembled modules that have a frame similar to that of the ceiling/floor panel. For use as a balcony, as opposed to a ceiling/floor panel, the exterior finish materials would a material suitable for exposure to weather, etc., as opposed to an interior finish, such as sheet rock, etc. The interior staircase (not depicted) may be manufactured at the factory as a module, or built at the home site, in conventional fashion.

(VI) Kitchen Backsplash Assembly. As previously mentioned, it is desirable to use as few standardized panels as possible in fabricating the present panel home. That is, it is advantageous to limit the customization of panels to the extent possible. It will be appreciated that the electrical requirements of the kitchen are typically the most complicated and extensive in the house. As such, it would be undesirable to customize the wall panels that are used in the kitchen to accommodate the requisite electrical circuitry.

Figure 12A:
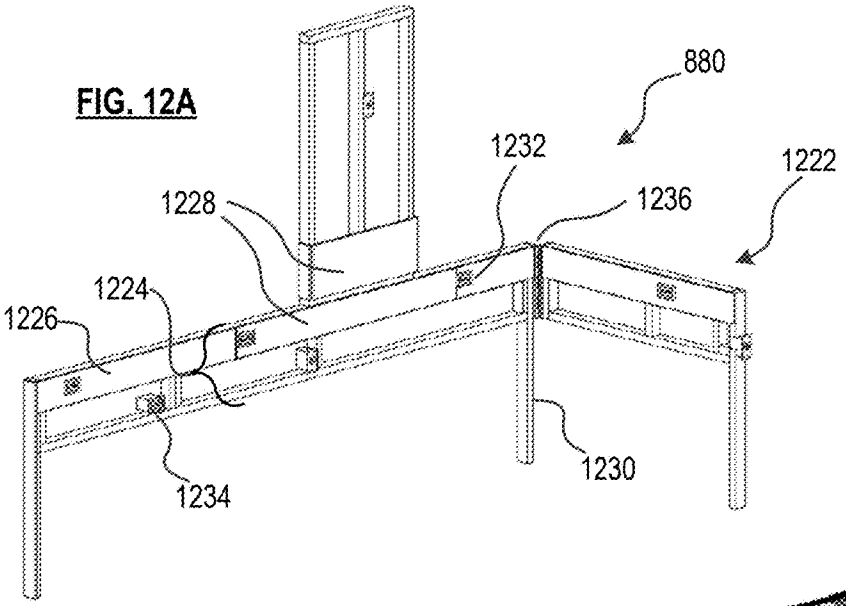
FIG. 12A depicts a kitchen backsplash assembly in accordance with an illustrative embodiment.
Figure 12B:
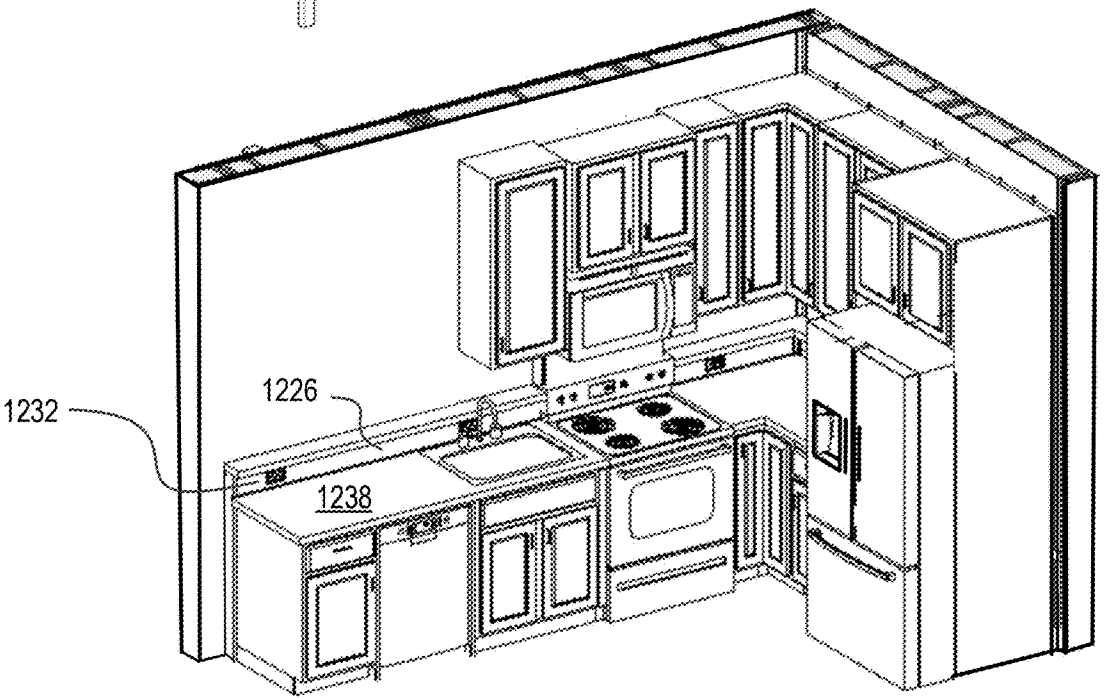
FIG. 12B depicts the kitchen backsplash assembly of FIG. 12A integrated into a kitchen environment.

To address this issue, in some embodiments, the electrical requirements for the kitchen are provided by kitchen backsplash assembly 880, which is depicted in front view in FIG. 12A, and shown integrated in a kitchen in FIG. 12B.

Kitchen backsplash assembly 880 comprises frame 1222, wherein the frame includes section 1224 that extends horizontally and receives electrical circuitry, and, in the illustrative embodiment, a plurality of legs 1230 for supporting section 1224. Section 1224 includes upper portion 1226, which is covered by finish surface material 1228. The legs are sized so that the bottom of upper portion 1126 is flush with the upper surface of kitchen countertops 1238, as depicted in FIG. 12B.

Section 1224 receives a requisite number of outlets 1232 (GCFI and standard) for appliances, junction boxes for connecting electrical conduits to circuit breakers in utilities-closet module 878, as well as outlets 1234 for the refrigerator, range, dishwasher, microwave. Outlets 1232 for countertop appliances are accessible through finish-surface material 1228 on upper portion 1226 of section 1224.

A portion of section 1224 extends vertically, and supports an electrical outlet in an elevated position, such as to serve as an outlet for a wall mounted microwave oven.

Kitchen backsplash assembly 880 can be fabricated in several different lengths and/or have different shapes, such as an L-shape, a U-shape, or linear, for compatibility with different kitchen layouts. In some embodiments, kitchen backsplash module 880 is hinged, such as via hinge 1236, such that it is foldable to a flat configuration for shipping, while still retaining required continuous electrical circuitry requirements.

Organizing the electrical circuitry in this fashion dispenses with the need to customize other features of the kitchen, such as cabinetry, countertops, and panels. As such via a single connection to electrical power, kitchen backsplash assembly 880 address all electrical needs of the kitchen.

Communications-enabled panels. In some embodiments, a communications tag (not depicted), such as RFID, BLE, or NFC-based tags, are embedded in the various exterior and interior panels used to construct the panel house. In some embodiments, at least one of the panels in closet module 874, bathroom module 875, and utilities-closet model 878 includes a communications tag. The communications tags serve as identifiers for each panel (or module), and can also be used to sense a connection between adjacent panels. In some embodiments, each such tag transmits identifying information about the associated panel (or module), such as an identification number, QR code, etc. In some embodiments, when two panels are coupled to one another, the two associated tags sense the connection. At least one of the tags generates a signal indicative of the coupling, and transmits the signal.

In some embodiments, a magnetic sensor (e.g., reed switch, etc.) or other type of sensor is coupled to each communications tag to sense the proximity between panels, and the spatial orientation thereof, such as the resulting lateral orientation and relative vertical positioning, and/or other parameters related to the quality of the coupling of the panels (hereinafter "a status of the panel"). It is important when assembling the panels that there is no more than about 0.5 inches of lateral and vertical tolerance. At least one of the sensors generates a signal indicative of the sensed proximity, and/or the spatial orientation of the coupled panels, and transmits the signal in conjunction with a transmitter.

Figure 13:
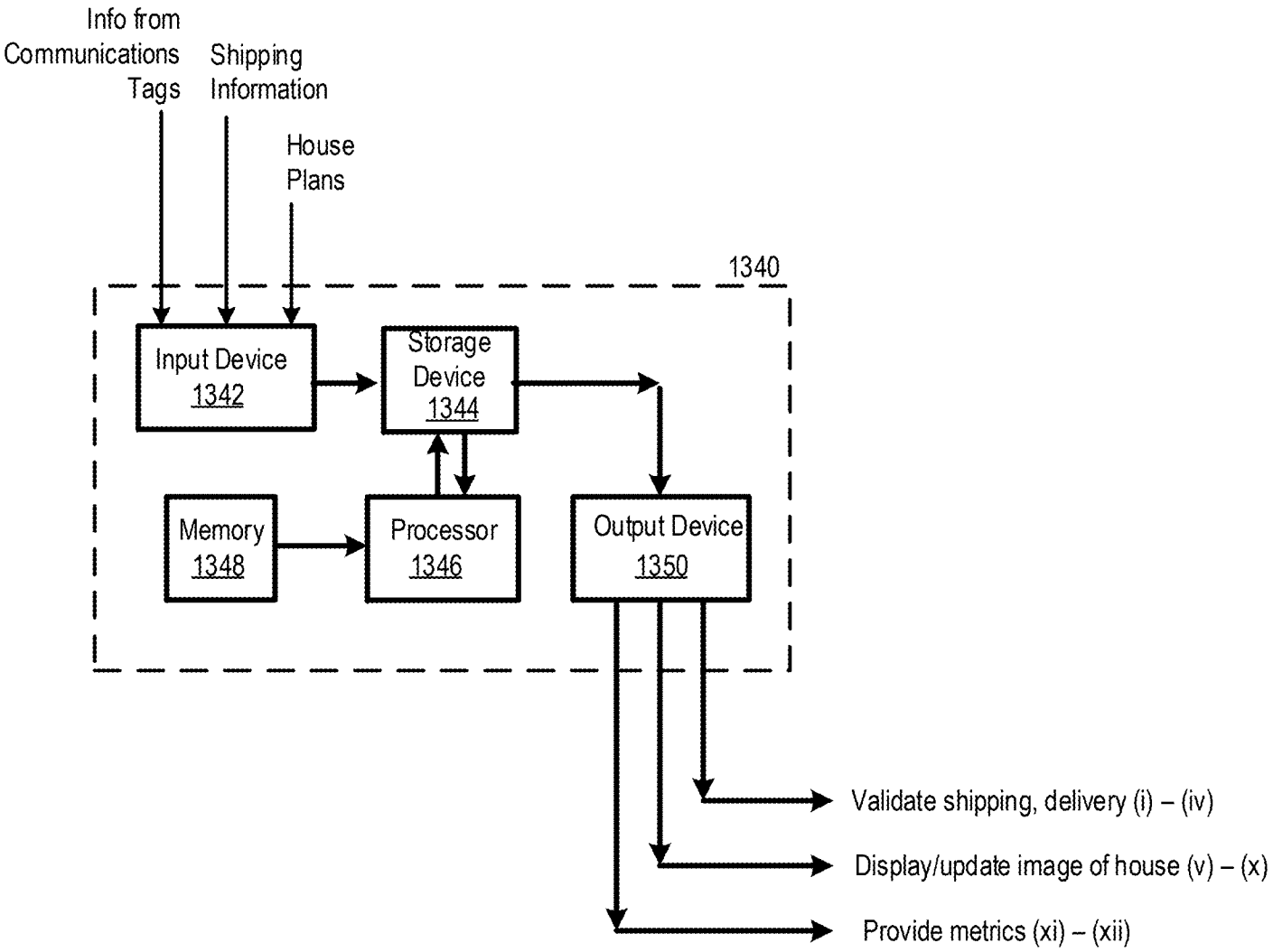
FIG. 13 depicts a data processing system in accordance with the illustrative embodiment.

Home Assembly Software. Referring now to FIG. 13, a software program (application), in conjunction with data processing system 1340, monitors and facilitates assembly of the panel house. The application receives, as input, one or more of (a) information transmitted by the communications tags, (b) shipping information, and (c) information about the particular panel house being built.

The application provides one or more of the following capabilities:

(i) verifies that the correct panels have been loaded for shipping to the home site;

(ii) provides metrics pertaining to expected and actual delivery time;

(iii) verifies that the (reporting) panels have been delivered to the home site;

(iv) provides a list of the reporting panels and reconciles it a shipping manifest/house plans;

(v) displays a wireframe image of the finished home. When a QR code or another panel or module identifier is entered into the application, the image indicates where that particular panel/module is to be positioned in the build, and also provides assembly order.

(vi) provides step-by-step directions for assembly of the panel home.

(vii) verifies that the correct panels have been coupled to one another;

(viii) verifies that the order of assembly is correct;

(ix) facilitates the placement and coupling of the panels during installation by providing information about panel position, alignment, and other measurable parameters.

(x) provides information about the quality of the coupling of panels (e.g., satisfactory, unsatisfactory);

(xi) provides a metric of completion and approximate remaining time for completion based on the typical and/or current rate of progress; and (xii) provide statistics for rates of completion of homes, areas for improvement based on assembly time of each panel, assessment of each site worker's efficiency, comparisons of the rate of completion to the number of site workers.

Any one of more of items (i) through (iv) are defined as "validating/validation of/validates shipping" for use herein and in the appended claims. Any one or more of items (v) through (xi) are defined as "facilitating and monitoring assembly" for use herein and in the appended claims. And the phrase "efficiency metrics" is defined as any of the items listed under (xii) above, for use herein and in the appended claims.

Data processing system 1340 includes input device(s)/circuitry 1342, storage device 1344, processor 1346, memory 1348, and output device(s) 1350. One or more busses typically interconnect the aforementioned devices/circuitry.

Data processing system 1340 is suitable for implementing the methods/functionality described herein as stored program-control instructions. Data processing system 1340 may be implemented as a "desk-top" computer, a "lap-top" computer, a "tablet" computer, a smart phone, etc.

Processor 1346 is a general-purpose processor. Processor 1346 executes instructions, such as those that required to accomplish the stated functionality of the home assembly software. Processor 1346 is capable of populating, updating, using, and managing data in memory 1348 and/or storage device 1344. In some alternative embodiments, the processor is a special-purpose processor.

Memory 1348 stores data and is a computer-readable medium, such as volatile or non-volatile memory. Storage device 1344 provides storage for data processing system 1340 including, without limitation, information transmitted from the communications tags, information transmitted from the sensor and transmitter, instructions for execution by processor 1346, as well as the results of executing such instructions. Storage device 1344 is a non-volatile, non-transitory memory technology (e.g., ROM, EPROM, EEPROM, hard drive(s), flash drive(s), a tape device employing magnetic, optical, or other recording technologies, or other solid-state memory technology, CD-ROM, DVD, etc.).

Input device(s)/circuitry 1342 receive input for data processing system 1340, and may include a keyboard, keypad, input port, transceiver or other communications device, for communications via any appropriate medium and via any appropriate protocol. Output device(s) 1350 may include a display, output port, and a transceiver or others communications device. Output device(s) 1350 is used to display, for example, an image of the home, assembly instructions, and other information as listed at items (i) through (xii) above.

Figure 24:
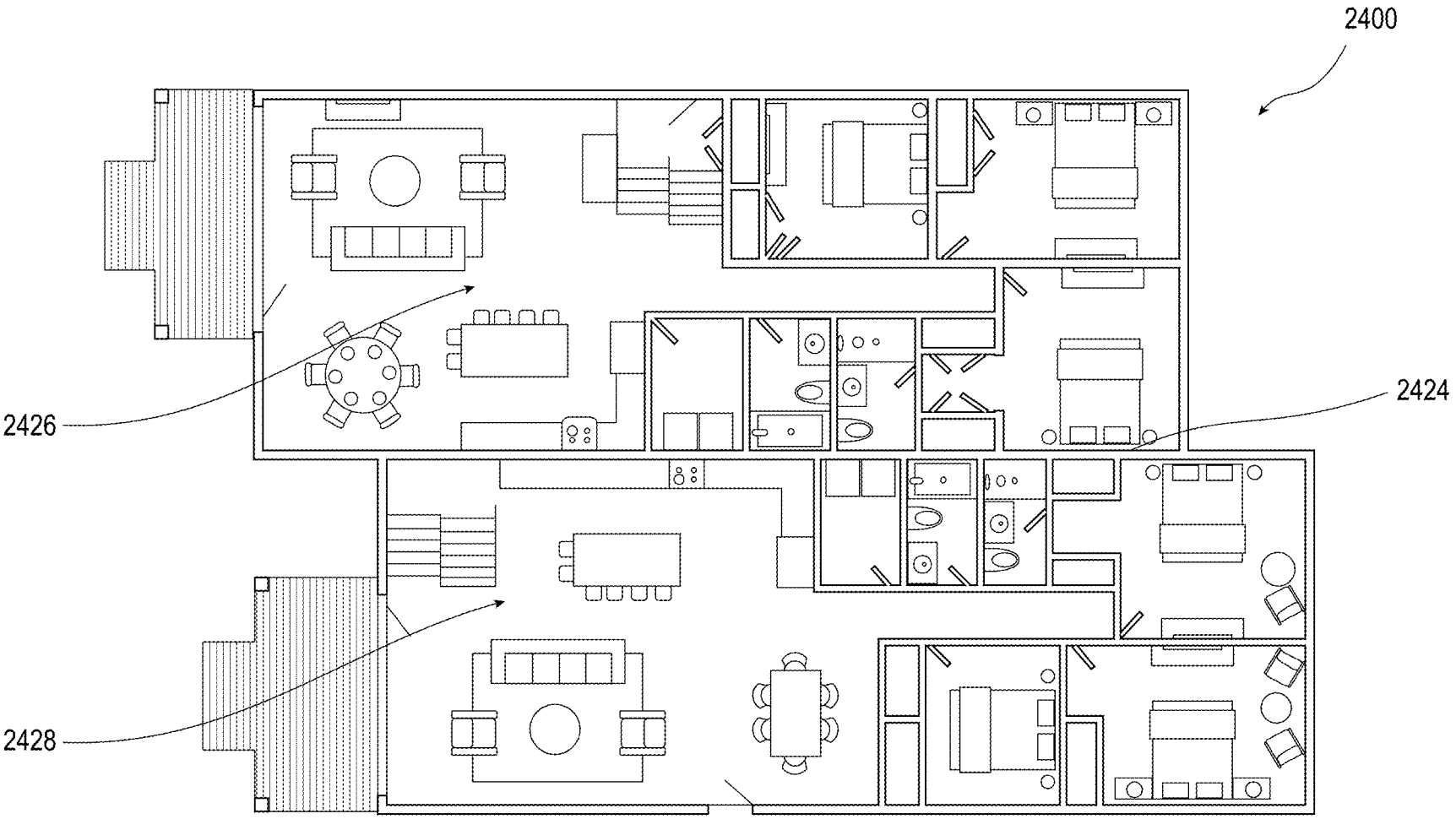
FIG. 24 depicts a panel house implemented as a duplex in accordance with the present teachings.

As previously disclosed, a panel house in accordance with the present teachings can be configured in a wide variety of ways, both externally and internally. For example, in two the single level and multi-level designs, a panel house in accordance with the present teachings can be designed as a duplex, the interior layout of an embodiment of which is depicted in FIG. 24.

For the most part, duplex panel house 2400 is constructed using the same types of panels and modules as the other panel houses described herein and shown in the appended drawings. However, and among any other distinctions, duplex panel house 2400 includes a plurality of wall panels 2424 that, while functioning as an "exterior" wall for each of the two living spaces 2426 and 2448, nevertheless have two interior-facing major surfaces. As such, both major surfaces of wall panels 2424 will include an interior-finish material. Since wall panels 2424 are load bearing, each such panel will have a structural frame comprising 2'×6' dimensional lumber. Additionally, panels 2424 include accessways that are accessible at both major surfaces, and will include separate electrical components, as required for the two separate living spaces 2426 and 2428.

Assembly Details. The design of the panel home enables it to be assembled on a slab, as opposed to a crawlspace foundation or a basement (although the panel home can be assembled on a crawlspace or basement). Historically, assembling a home (other than a stick-built home) on a cement slab has been difficult because it is necessary to complete the plumbing and other utilities at the home site before the fixtures are built/installed. This can result in problematic alignment issues for a pre-built home.

In accordance with the present teachings, the bathroom modules are constructed so that plumbing is built in, and only one connection is required for each of hot water, cold water, and sewer during assembly. These connections are designed to be as compliant as possible to take normal building tolerances into consideration. Other water/drain connections (e.g., kitchen sink, washer, etc.) are designed to have noncritical location dimensions. In some embodiments, an alignment fixture is provided to the local building contractor to ensure that utility lines, etc., in the slab are properly positioned for mating to the appropriate lines from the panel home.

Exterior Panels: Securing Panels to the Foundation. The coupling between the panels and the foundation must ensure structural integrity, and, preferably, the requisite tolerances at the coupling locations should be as relaxed as possible.

Figure 14:
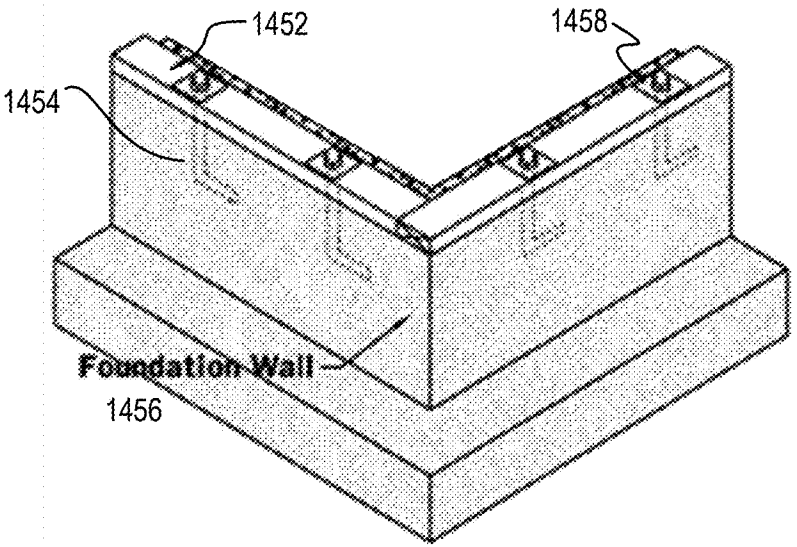
FIG. 14 Prior Art
FIG. 14 depicts a sill plate on a foundation in the prior art.

In a stick-built home, and in prior-art panel-built homes, sill plate 1452 is installed onto "J-bolts" 1454 that are sunk into foundation 1456, as depicted in FIG. 14. Sill plates 1452 are drilled on-site to match the location of J-bolts 1454. A threaded length of each J-bolt 1454 extends beyond sill plate 1452 and receives a washer and nut 1458 by which the sill plate is secured to the foundation. Floor joists 1460 are positioned atop sill plate 1452, and the floor joists are topped with underlayment (e.g., plywood, etc.). In a prior-art panel-built home, the exterior panels are attached to the underlayment.

For the present panel home, for embodiments in which the foundation is a slab, there are no floor joists, etc. The exterior panels reside directly on the sill plate. As such, the protruding top of the J-bolts would require that the bottom of the panels be appropriately pre-drilled to accept them. But it is unlikely the J-bolts, which are sunk into the slab as it's being poured, could be reliably positioned with the accuracy required to be received by the pre-drilled holes in the bottom of the frame of the panels. An alternative approach that provides equivalent structural strength, provides substantial positioning tolerance, and reduces the amount of factory pre-drilling is thus desirable.

Figure 15:
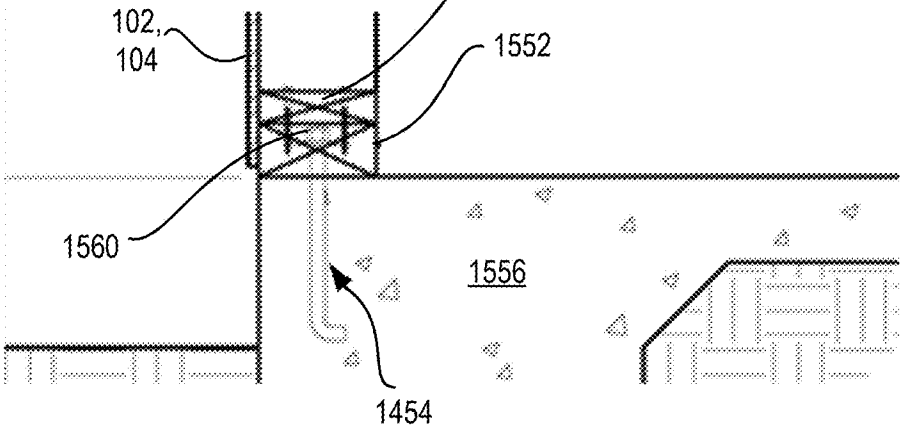
FIG. 15 depicts a method for coupling exterior panels to a foundation in accordance with the present teachings.
Figure 17A:
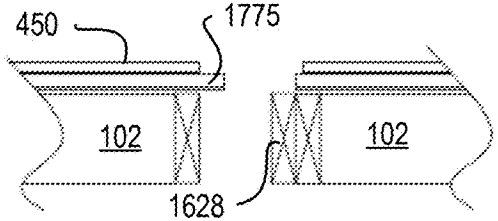
FIGS. 17A-17E depict a second method for coupling exterior panels to one another in accordance with the present teachings.
Figure 17B:
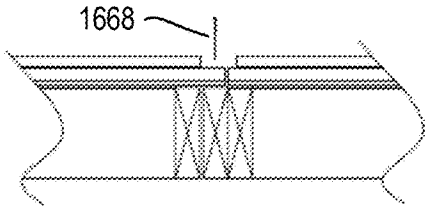
Figure 17C:
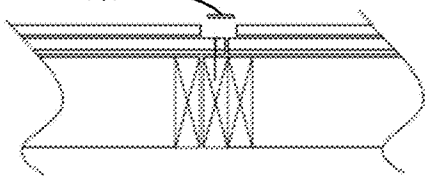
Figure 17D:
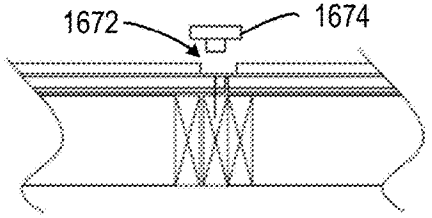
Figure 17E:
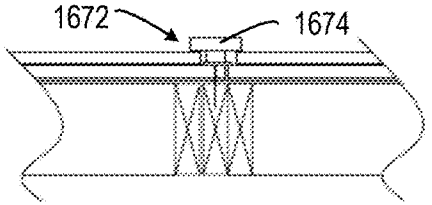

In accordance with the illustrative embodiment, a thicker-than-standard sill plate 1552 is used (approx. 2× times the nominal thickness). The holes in sill plate 1152 for receiving J-bolts 1454 are counterbored so that the nuts and washers required for securing the j-bolts remain below the upper surface of sill plate 1552 at position 1560, as depicted in FIG. 15. Thus, sill plate 1552 is securely bolted to slab 1556, and the exterior panels (e.g., exterior wall panel 102 and exterior window panel 104) can thus be placed on sill plate 1552 without interference from protruding j-bolts. The bottommost piece of lumber ("bottom plate") 1562 of the frame of each such exterior panel is then simply screwed to sill plate 1552, accessing bottom plate 1562 via accessway 454 on the interior-facing surface each exterior panel. This approach avoids any alignment issues.

Exterior Panels: Securing Panels to One Another. There are several considerations when connecting any two exterior panels together; namely, structural integrity, weather sealing, and aesthetics.

FIGS. 16A through 16E depict a method for securing exterior panels that are clad with sheathing 1664, house wrap 1666 (e.g., Tyvek®, etc.), and exterior finish material 450. FIGS. 17A through 17E depict a method for securing exterior panels that are clad with sheathing 1664 that incorporates a weather barrier, and exterior finish material 450. In the illustrative embodiment, two exterior wall panels 102 are being connected. The method applies to securing any type of exterior panel (wall, window, door) to another exterior panel (wall or window or door).

Figure 16A:
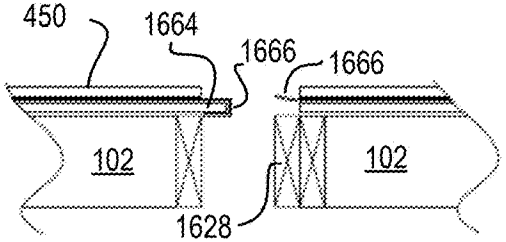
FIGS. 16A-16E depict a first method for coupling exterior panels to one another in accordance with the present teachings.
Figure 16B:
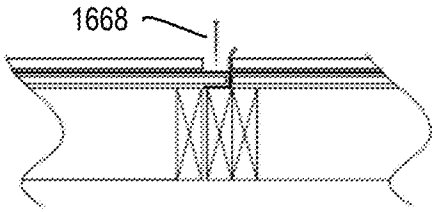

To satisfy structural considerations, exterior panels, including exterior wall panels, exterior window panels, and exterior door panels, are designed so that sheathing overlaps from one panel to the next. Specifically, in FIGS. 16A, sheathing 1664, respectively, at one (lateral) edge of an exterior panel extends beyond that panel's frame, and at the other (lateral) edge of the panel, the endmost stud remains at least partially exposed. As depicted in FIG. 16B, the panels are positioned so that sheathing 1664 from one panel 102 overlaps the exposed stud on adjacent panel 102. The overlapping sheathing is then nailed, via nails 1668, to the exposed stud, as depicted in FIGS. 16B/C.

Figure 16C:
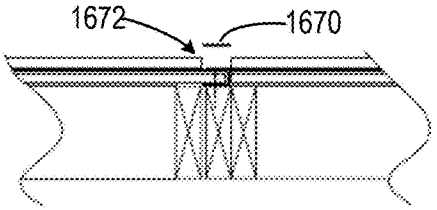
Figure 16D:
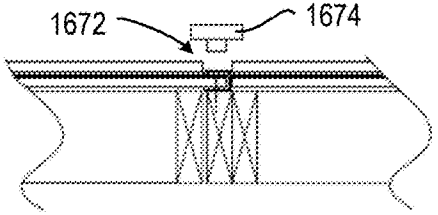
Figure 16E:
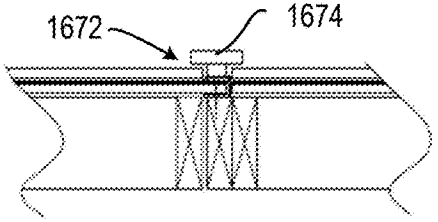

When using sheathing 1664 that does not include an integral weather barrier, a weather-seal must be established between adjacent panels. As depicted in FIG. 16A, in the illustrative embodiment, house wrap 1666 is wrapped around the overhanging end of sheathing 1664, and a loose "flap" of house wrap is provided at the other lateral edge (shown for the adjacent panel 102). After panels 102 are nailed together, the loose flap of house wrap is positioned over the house wrap on the overhanging end of the sheathing and glued thereto, as depicted in FIG. 16C. A piece of tape 1670 (selected for use on house wrap 1666), is adhered to the house wrap at region 1672 between the panels. To satisfy aesthetic considerations, trim panel 1674 is secured to the exterior of panels 102 at region 1672 cover up the exposed seam between panels using finish nails.

With the exception of overlapping the house wrap, the procedure is essentially the same when using sheathing 1775 that includes an integral weather barrier, as depicted in FIGS. 17A through 17E.

Wall Panels Intersecting at 90 Degrees: There will be a number of locations at which an interior panel couples to the interior-facing surface of an exterior panel. This coupling involves both structural and electrical considerations.

The interior panels are sited after the exterior panels are coupled to one another to form the exterior of the house. At this point, the trim panel has not been placed over accessway 454 (see, e.g., FIG. 4B) on both the interior and exterior panels, leaving the studs and electrical circuits exposed. In some embodiments, an upper bracket and lower bracket are used to couple the interior and exterior panels to one another. The lower bracket is covered by the lower trim panel (that covers accessway 454) and the upper bracket is covered by an upper trim panel after the entire house is assembled and inspected as required. Regarding electrical, a length of wire creates electrical continuity between the interior panel to the exterior panel. The length of wire, which is placed in the interior wall panel during factory assembly, is connected, when on site, to the nearest junction box or electrical outlet in the exterior wall (that is on the designated circuit). Rather than using brackets, the panels may alternatively be nailed to one another.

Figure 18A:
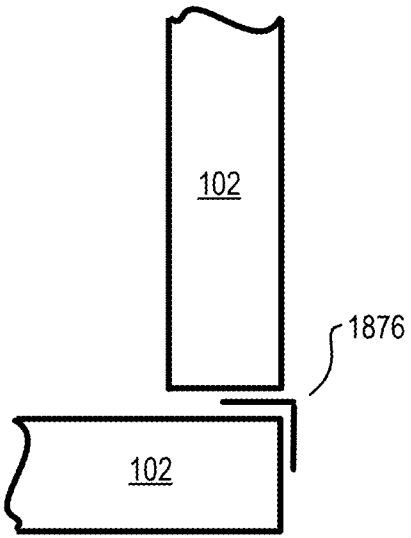
FIGS. 18A-18C depict a method for coupling exterior panels to one another at a corner of a panel house in accordance with the present teachings.
Figure 18B:
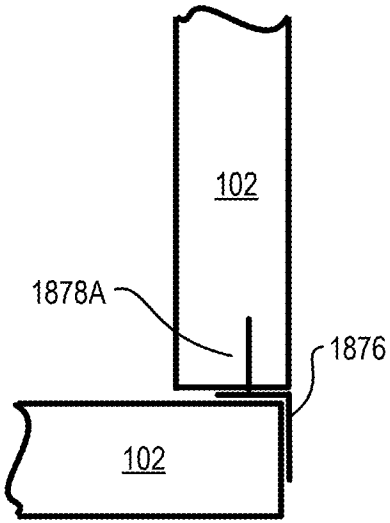
Figure 18C:
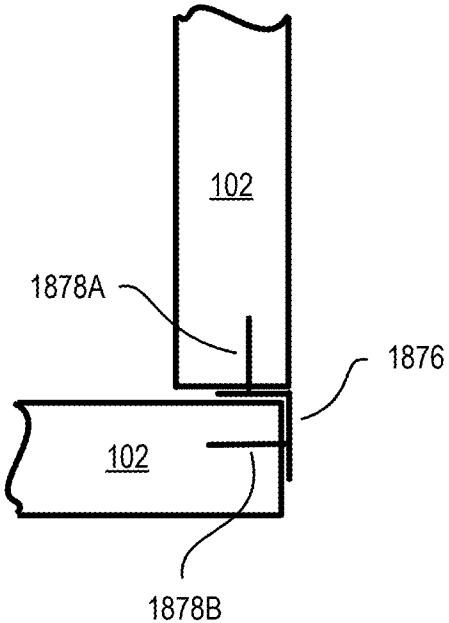

There will also be locations, such as at corners of the house, where exterior panels abut one another at ninety degrees. In some embodiments, the exterior corner connections are accomplished using metal brackets on the exterior side of the corner, as depicted in FIG. 18A through 18C (plan view). These figures depict two exterior wall panels 102 at a corner of a panel house. Bracket 1876 is screwed, via screws 1878A and 1878B, into panels 102 at the home site. After the exterior panels are connected, a top plate is place on top of all exterior walls. The top plates will each overlap plural panels, providing additional rigidity to the house.

Figure 19A:
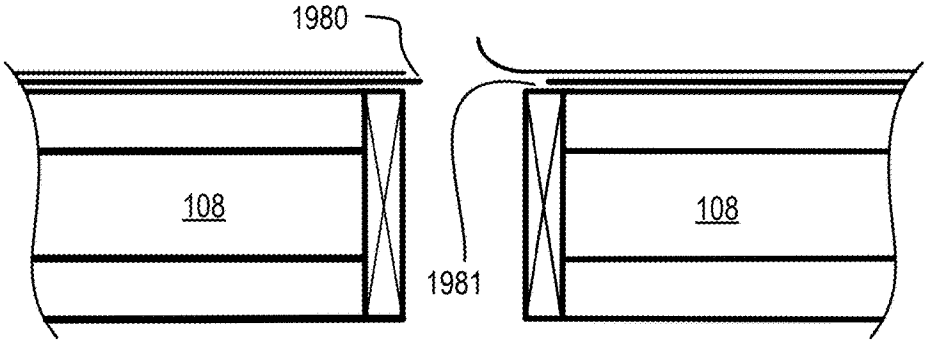
FIGS. 19A-19C depict a method for coupling roof panels to one another in accordance with the present teachings.
Figure 19B:
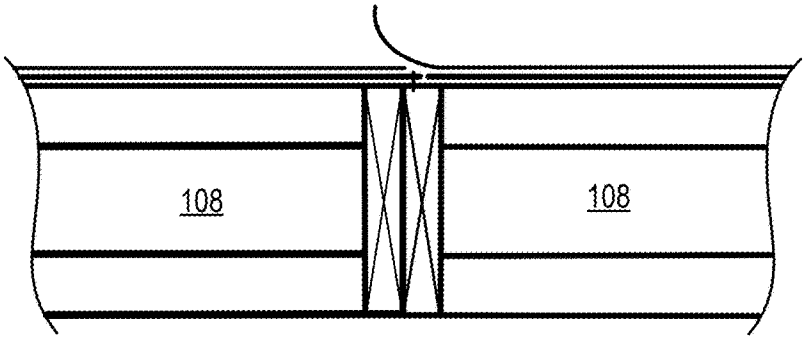

Roof Panels: Adjacent roof panels 108 couple to one another to provide the requisite structural integrity. To that end, and as depicted in FIG. 19A, sheathing 1980 at one (long lateral) edge of each roof panel 108 extends beyond the panel's frame, and at the other (long lateral) edge of each panel, portion 1981 of the endmost stud remains exposed. Once two roof panels 108 are in position for joining, sheathing 1980 from one roof panel 108 overlaps exposed portion 1981 of the end stud on adjacent roof panel 108. The overlapping sheathing 1980 is then nailed to the exposed portion 1981 of the stud, as depicted in FIG. 19B. A layer of insulating Foam (not depicted) is attached to the exterior surface of the sheathing to provide a continuous coverage of insulation. This outside insulation adds to the internal batting insulation, but more importantly covers the thermal bridges (beams) of the roof panels 108.

Figure 19C:
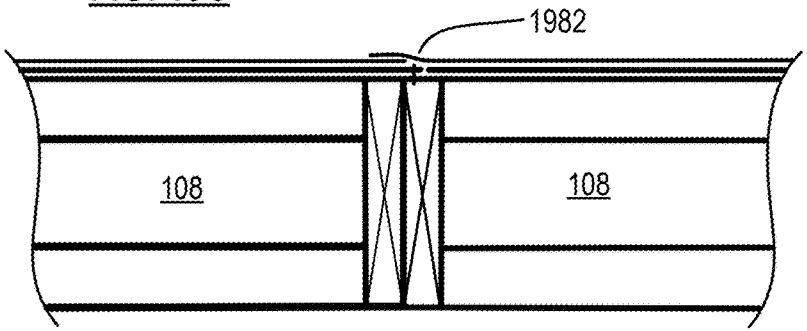

The underlayment (not depicted) is overlapped after the nailing process, analogous to the manner in which the housewrap is overlapped during the assembly of exterior wall panels. Finally, roofing material 1982 (e.g., asphalt roll, etc.) is overlapped, as depicted in FIG. 19C, and the resulting seam is heat sealed. It is notable that there are no (vertical) gaps between the sheathing and the top of the roof panels, and between the roofing material and the sheathing; the gaps are depicted for clarity of illustration.

Figure 20:
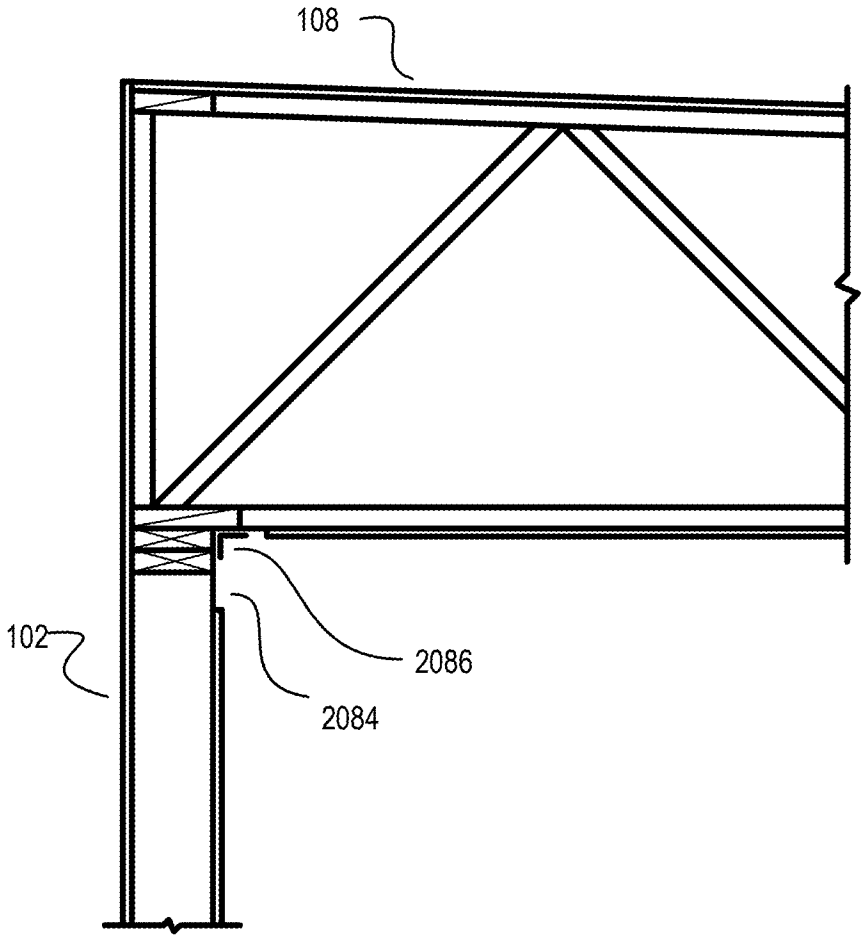
FIG. 20 depicts a method for coupling a roof panel to an exterior panel in accordance with the present teachings.

Securing the Roof to Walls: In some embodiments, roof panels 108 are secured to exterior wall, window, and door panels via brackets 2086, as depicted in FIG. 20. In some embodiments, brackets 2086 are factory-installed on the roof panels. Region 2084 near the top of the exterior panels on the interior-facing surface is not covered with an interior finish material (e.g., sheetrock, etc.) so that it can receive a portion of bracket 2086. After roof panels 108 are placed on the exterior panels, a portion of bracket 2086 is screwed into the exterior panels. Interior moldings (not depicted) are placed over brackets 2086 for aesthetic purposes.

Closet Module Installation. As previously discussed, the closet is factory assembled, wherein four wall panels are coupled with rotatable hinges (e.g., piano hinges). This enables the closet module to fold substantially flat for shipping. A fifth hinged panel can be used on top of the wall panels to form a ceiling, as desired. Hinged (i.e., foldable) shelves/rods can be folded for shipping and unfolded on-site. In some embodiments, the closet module includes factory-installed electrical circuitry and light fixtures, to further reduce on-site work. A single electrical connection to the closet module powers a receptacle, light switch, and lighting.

Figure 22B:
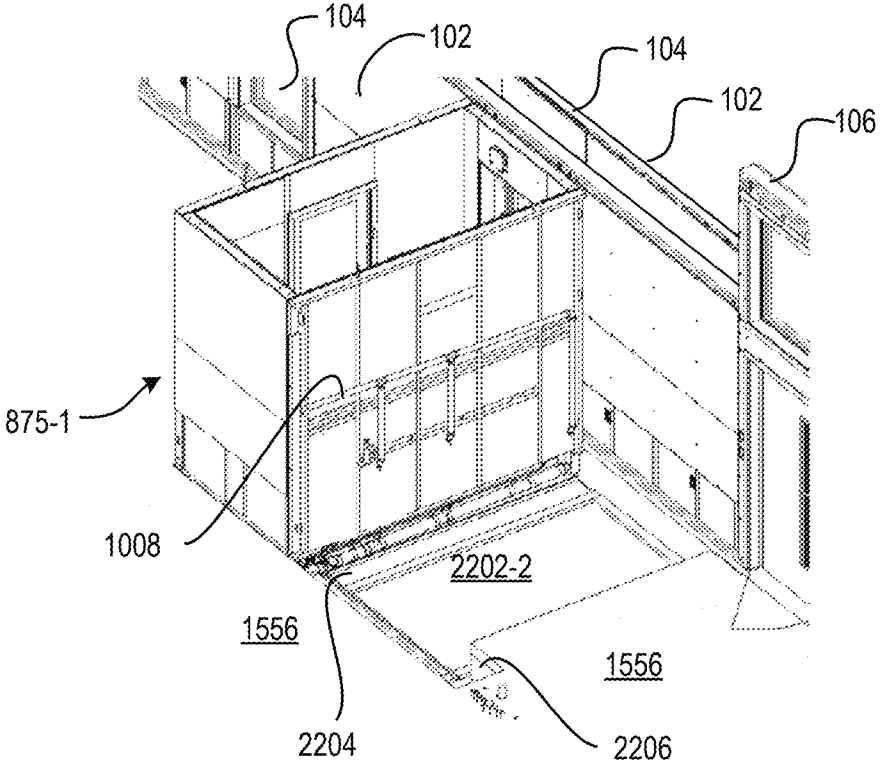
FIG. 22B depicts a first bathroom module within one of the recesses shown in FIG. 22A.
Figure 22A:
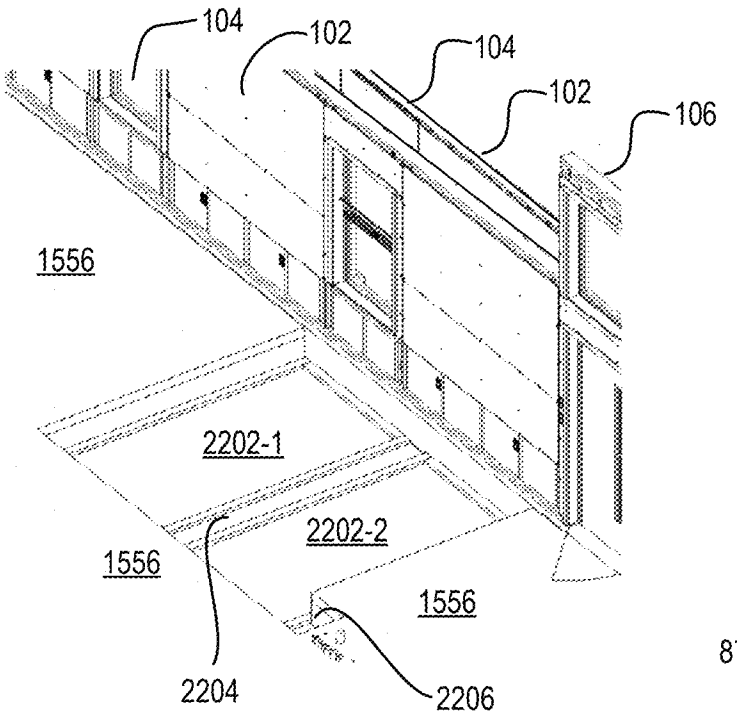
FIG. 22A depicts recesses in a slab for receiving bathroom modules in accordance the present teachings.

Connection of Bathroom module 875. The bathroom module is integrated into the panel house at one or more specified locations in the foundation. FIG. 22A depicts a portion of slab 1556, and a portion of the exterior of the panel house (showing exterior door panel 106, two first exterior wall panels 102, and two exterior window panels 104). Two recessed regions 2202-1 and 2202-2 are formed within slab 1556 and they are each sized to receive one bathroom module, 875-1 and 875-2, respectively. FIG. 22B depicts bathroom module 875-1 sited within recessed region 2202-1. As can be seen in FIG. 22B, the recessed regions 2202-1 and 2202-2 have a depth suitable for accommodating floor panel 1096 below each bathroom module. In particular, the depth is such that when a floor panel 1096 is received within one of recessed regions 2202, the "floor" of bathroom module 875 is flush with the upper surface of slab 1556.

There is a gap 2204 between recessed regions 2202-1 and 2202-2. This gap accommodates vent lines 1008 disposed on the exterior of one of the wall panels composing bathroom module 875. Bathroom modules 875-1 and 875 are necessarily arranged such that wall panel of each module that accommodates the vent lines, piping, etc., opposed one another, such that vent lines 1008 from both modules are situated within gap 2204.

A recessed region 2206 is also provided within slab 1556. This recess accommodates the main drain line for the panel house; this drain line passes through slab 1556 to couple to the city sewer or the homes septic system (see FIG. 22D). Utilities-closet module 878 is positioned on the slab such that a portion of utilities-closet module 878 is above recessed region 2206.

Figure 22C:
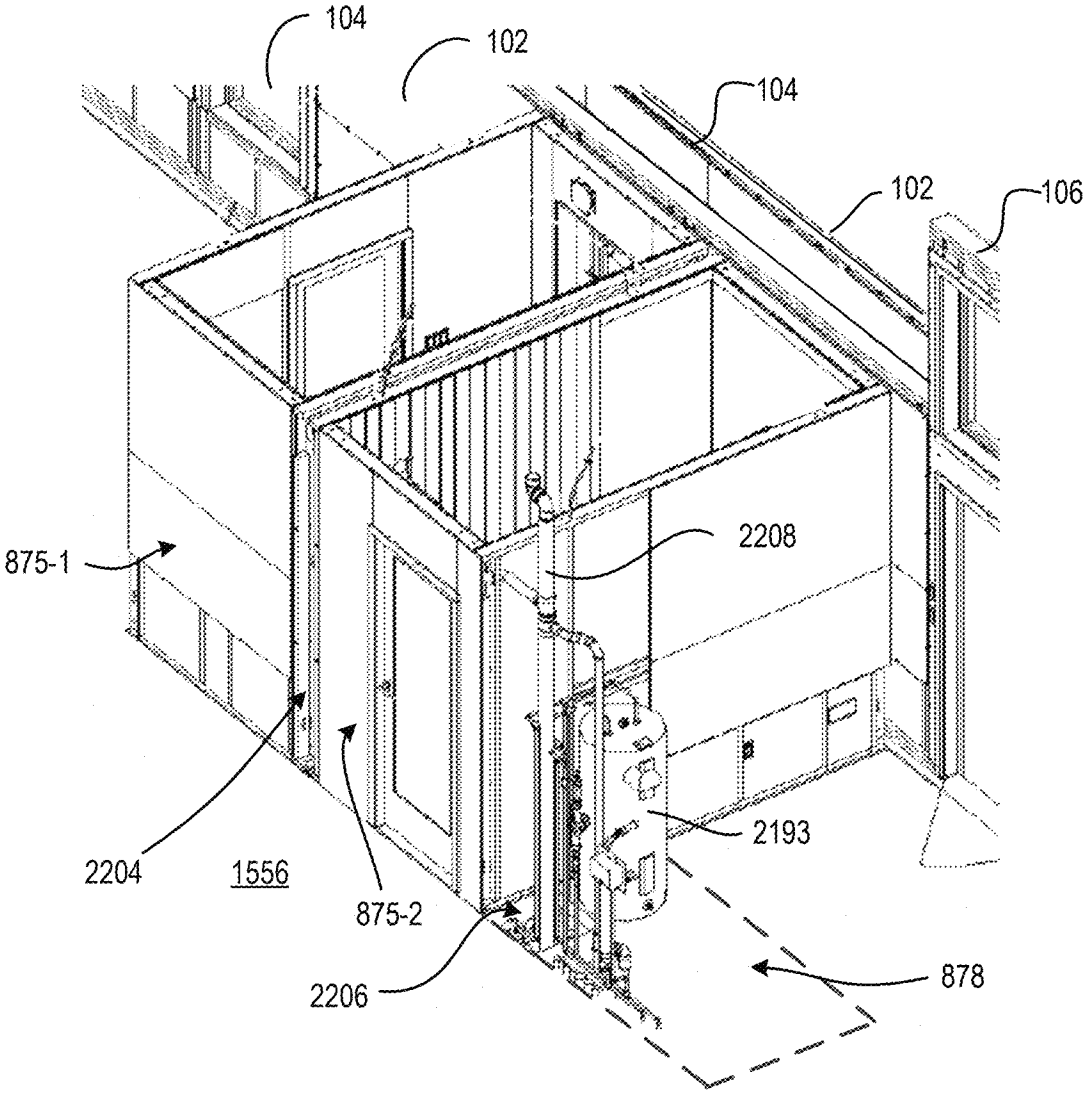
FIG. 22C depicts a second bathroom module within another of the recesses shown in FIG. 22A, and a portion of the utilities-closet module.

FIG. 22C depicts a second bathroom module 875-2 sited in the second recessed region 2202-2. The outline of the perimeter of utilities-closet module 878 is depicted in this Figure, as well as hot water heater 2193, vent line 2208, and other piping.

Figure 22D:
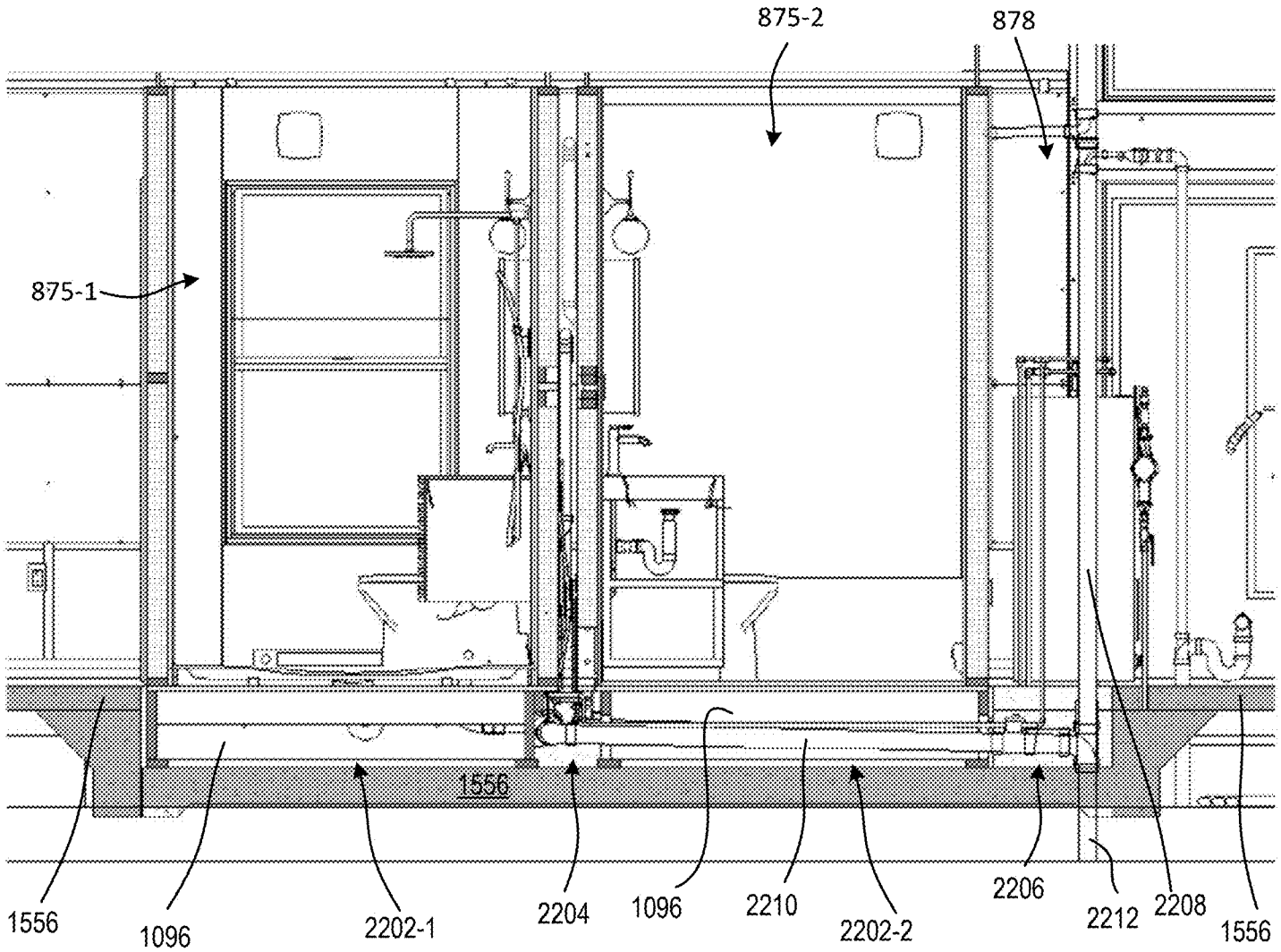
FIG. 22D depicts a cross section of FIG. 22C, showing the integration of fluidic conduits from two of the bathroom modules and integration with fluidic conduits from the utilities-closet module.

FIG. 22D depicts a cross-sectional view of FIG. 22C. This figure depicts floor modules 1096 within recessed regions 2202-1 and 2202-2. Drain line 2210, which couples to drain port 1006 (see FIG. 10B) of bathroom module 875-1, passes through floor module 1096 of bathroom module 875-2 and couples to main drain 2212 that passes through slab 1556. Drain port 1006 of bathroom module 875-2 couples to drain line 2210 as well.

Because bathroom modules 875 have all required plumbing, installation into a panel house entails a few fluidic connections: drain port 1006 is coupled to drain line 2210, one hot water connection (not depicted), one cold water connection (not depicted), and one vent connection. The drain port and the connections for hot and cold water are located in floor module 1096. Other than making those connections, no additional on-site plumbing work is required. In addition to these plumbing connections, there is one electrical connection (not depicted) at the top of the wall feeding a GFI outlet near the sink. The door to the bathroom is a standard interior door panel with a light switch included.

Definitions. The following terms are defined for use in this disclosure and the appended claims:

"Factory finished" when used to reference an exterior panel, means that as manufactured and prior to leaving the factory, the exterior panel will include (a) an interior surface finish material (e.g., painted sheetrock, Dupont Corian® interior cladding, etc.) on the interior facing side, and, on the exterior facing side (b) sheathing (e.g., plywood, oriented strand board [OSB], structural fiberboard, etc.), (c) an outer weather barrier, (d) an exterior surface finish material, (e) thermal insulation, and (f) one or more of any of the following: electrical outlets, electrical junction boxes, electrical wire(s), electrical switches (collectively "electrical components"), etc. In some embodiments, the sheathing includes a weather barrier, such that no separate outer weather barrier is required. For an exterior window panel, a window is included, and for an exterior door panel, a door is included.

"Factory finished" when used to reference an interior panel, means that as manufactured and prior to leaving the factory, the interior panel will include (a) an interior finish surface material on both sides, and (b) electrical components, at a minimum. For an interior door panel, a window is included.

"Footprint" when used to reference the size of a module, means the perimeter (shape and size) defined by the module (as installed for a closet module).

"Substantially" or "about" means+/−20% of a stated number.

It is to be understood that the disclosure describes a few embodiments and that many variations of the invention can easily be devised by those skilled in the art after reading this disclosure and that the scope of the present invention is to be determined by the following claims.

What is claimed:

1. An article for providing electrical requirements for a residential kitchen, the article consisting of:

a frame having:

(a) an electrical-componentry portion including a plurality of electrical outlets and electrical conduits, the electrical-componentry portion extending horizontally when installed in a residential kitchen and having an upper part and a lower part, the upper part having a finish surface material disposed thereon and functioning as a backsplash when installed, wherein the electrical outlets are accessible through the finish surface material;

(b) a plurality of legs that elevate the electrical-componentry portion of the frame to a height wherein the bottom of the upper part is substantially flush with a countertop within the kitchen; and an electrical connection by which electricity is provided to the electrical componentry in the frame.

2. The article of claim 1 wherein the frame is foldable.

3. The article of claim 2 wherein the frame includes hinges.

4. The article of claim 1 wherein the frame has an L-shape.

5. The article of claim 1 wherein the frame has a U-shape.

6. The article of claim 1 wherein the frame is linear.

7. The article of claim 1 wherein a segment of the electrical componentry portion of the frame extends upwardly, the segment including an electrical outlet.

* * * * *